US009638003B2

(12) United States Patent
George et al.

(10) Patent No.: US 9,638,003 B2
(45) Date of Patent: May 2, 2017

(54) SLEEVE VALVE

(71) Applicant: Schlumberger Technology Corporation, Sugar Land, TX (US)

(72) Inventors: Grant George, Calgary (CA); Shane Sargent, Calgary (CA); Curtis Ring, Millarville (CA); Matthew McCarthy, Calgary (CA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 669 days.

(21) Appl. No.: 13/845,489

(22) Filed: Mar. 18, 2013

(65) Prior Publication Data

US 2014/0174746 A1 Jun. 26, 2014

Related U.S. Application Data

(63) Continuation-in-part of application No. 13/726,499, filed on Dec. 24, 2012, now abandoned.

(51) Int. Cl.

| | |
|---|---|
| ***E21B 34/12*** | (2006.01) |
| ***E21B 43/26*** | (2006.01) |
| ***E21B 34/14*** | (2006.01) |
| ***E21B 43/14*** | (2006.01) |

(52) U.S. Cl.

CPC ..... *E21B 34/14* (2013.01); *E21B 43/14* (2013.01); *E21B 43/26* (2013.01)

(58) Field of Classification Search

CPC ..... E21B 34/12; E21B 34/14; E21B 43/162; E21B 43/26

USPC ..... 166/332.1, 334.4, 381, 386

See application file for complete search history.

(56) References Cited

U.S. PATENT DOCUMENTS

| | | | | |
|---|---|---|---|---|
| 2,920,764 | A * | 1/1960 | Hodges | E21B 34/12 137/508 |
| 3,115,188 | A * | 12/1963 | Cochran | E21B 34/14 166/332.4 |
| 3,599,712 | A * | 8/1971 | Magill | E21B 23/04 166/212 |
| 4,312,406 | A * | 1/1982 | McLaurin | E21B 23/04 166/212 |

(Continued)

OTHER PUBLICATIONS

International Search Report and Written Opinion for International Application No. PCT/US2014/030960 dated Aug. 14, 2014, 16 pages.

*Primary Examiner* — Kenneth L Thompson
(74) *Attorney, Agent, or Firm* — Jeffrey R. Peterson

(57) ABSTRACT

An sleeve valve for a well assembly includes at least one set of passages extending through a tubular body between the central passage and an exterior of the tubular body and a sleeve slidably located within the central passage of the valve body adapted to selectably sealably cover or uncover the at least one sets of passages. A shifting tool for actuating the sleeve valve is connectable to a tool string and includes a shifting bore with an actuating piston extending from a central bore through the shifting tool and first and second key bores extending radially inwards from the outer surface each having a piston keys located therein. Each of the first and second piston keys is operably connected to the actuating piston so as to be extended from the outer surface when the central bore is supplied with a pressurized fluid.

17 Claims, 27 Drawing Sheets

(56) References Cited

U.S. PATENT DOCUMENTS

| | | | | |
|---|---|---|---|---|
| 5,259,451 | A * | 11/1993 | Kent | E21B 34/14 166/154 |
| 5,957,207 | A * | 9/1999 | Schnatzmeyer | E21B 34/06 166/320 |
| 6,253,861 | B1 * | 7/2001 | Carmichael | E21B 21/103 175/237 |
| 7,243,723 | B2 * | 7/2007 | Surjaatmadja | E21B 34/14 166/177.5 |
| 8,307,902 | B2 * | 11/2012 | Telfer | E21B 21/103 137/625.27 |
| 2002/0007949 | A1 | 1/2002 | Tolman et al. | |
| 2006/0207763 | A1 | 9/2006 | Hofman | |
| 2009/0084553 | A1 * | 4/2009 | Rytlewski | E21B 34/06 166/305.1 |
| 2010/0270030 | A1 * | 10/2010 | Ashy | E21B 21/103 166/373 |
| 2012/0012322 | A1 * | 1/2012 | Korkmaz | E21B 43/26 166/308.1 |
| 2012/0118573 | A1 | 5/2012 | Richard et al. | |
| 2012/0125627 | A1 | 5/2012 | George et al. | |
| 2012/0152550 | A1 | 6/2012 | East, Jr. | |
| 2013/0048273 | A1 | 2/2013 | Crow et al. | |
| 2013/0168099 | A1 * | 7/2013 | Themig | E21B 34/103 166/308.1 |
| 2013/0319658 | A1 * | 12/2013 | Huh | E21B 33/13 166/250.01 |
| 2014/0251609 | A1 * | 9/2014 | Broussard | E21B 43/04 166/278 |
| 2015/0361747 | A1 * | 12/2015 | Lafferty | E21B 34/14 166/373 |
| 2016/0123112 | A1 * | 5/2016 | Purkis | E21B 34/14 166/320 |

* cited by examiner

SLEEVE VALVE

CROSS REFERENCE TO RELATED APPLICATION

This application is a continuation-in-part of application Ser. No. 13/726,499 filed Dec. 24, 2012, entitled Sleeve Valve which is a continuation in part of application Ser. No. 13/274,893 filed Oct. 17, 2011, entitled Sleeve Valve which claims priority from U.S. Provisional Patent Application No. 61/344,812 filed Oct. 15, 2010 entitled Downhole Control Valve System.

BACKGROUND OF THE INVENTION

1. Field of Invention

The present invention relates to hydrocarbon well control in general and in particular methods and apparatuses for selectably opening and closing zones within a hydrocarbon well during completion, hydraulic fracturing or production.

2. Description of Related Art

In hydrocarbon production, it has become common to utilize directional or horizontal drilling to reach petroleum containing rocks, or formations, that are either at a horizontal distance from the drilling location. Horizontal drilling is also commonly utilized to extend the wellbore along a horizontal or inclined formation or to span across multiple formations with a single wellbore. With horizontal drilling the well casing is prone to resting upon the bottom of the wellbore requiring the use of spacers so as to centre the casing within the wellbore.

In horizontal hydrocarbon wells, it is frequently desirable to select which zone of the wellbore is to be opened for production or to stimulate one or more zones of the well to increase production of that zone from time to time. One current method of stimulating a portion of the well is through the use of hydraulic fracturing or fracking. One difficulty with conventional fracking systems, it that is necessary to isolate the zone to be stimulated on both the upper and lower ends thereof so as to limit the stimulation to the desired zone. Such isolation has typically been accomplished with sealing elements known as production packers located to either side of the zone to be isolated. The use of such One of the prior problems with current fracking methods is that most hydrocarbon wells are constructed with a well casing located within the wellbore which is cemented in place by pumping cement down the casing to the bottom of the well so as to fill the annulus between the casing and the wellbore from the bottom up. Such concrete provides an additional barrier between the center of the well casing and wellbore which is to be fracked. In conventional methods, in order to thereafter frack a zone which has been constructed in such a manner, it is necessary to form a conduit from the interior of the casing to the wellbore wall by fracturing the cement as well as the formation. Needing to fracture the concrete as well as the formation increases the pressure required for the fracking process thereby increasing the equipment requirements as well as the resulting cost and time requirements.

Previous attempts to resolve some of the above difficulties has been to provide valves inline within the casing so as to selectably provide access to the desired zones of the well. Such valves may be sliding valves having actuators such as are described in US Patent Application Publication No. 2006/0207763 to Hofman published Sep. 21, 2006. With the use of such sliding valves however, it is still necessary to fracture, dissolve or otherwise perforate the concrete surrounding the casing to access the formation.

SUMMARY OF THE INVENTION

According to a first embodiment of the present invention there is disclosed an apparatus for selectably permitting fluidic communication between an interior and an exterior of a well assembly comprising a tubular body extending between first and second ends and having a central passage extending therebetween, the first and second ends being connectable to the well assembly such that the central passage is in fluidic communication with an interior of the well assembly. The apparatus further includes at least one set of passages extending through the tubular body between the central passage and an exterior of the tubular body and a sleeve slidably located within the central passage of the valve body adapted to selectably sealably cover or uncover the at least one sets of passages. The apparatus further includes a shifting tool slidably locatable within the sleeve at an end of a tool string the shifting tool being engagable upon the sleeve so as to permit the shifting tool to move the sleeve longitudinally within the tubular body.

The apparatus may further comprise first and second sets of passages extending through the tubular body. The sleeve may be locatable at a first position covering both of the first and second sets of passages, a second position covering the first set of passages and uncovering the second set of passages and a third position uncovering the first set of passages and covering the second set of passages. The second set of passages may include flow channels extending along the tubular body and having a filter located therearound. The second set of passages may include a plurality of outlet nozzles positioned to direct a flow of fluid to the exterior of the well assembly. The nozzles may be oriented substantially parallel to a central axis of the tubular member.

The shifting tool may comprise a body having a central bore extending therethrough and an outer surface, at least one shifting bore extending from the central bore wherein each shifting bore includes an actuating piston located therein and first and second key bores extending radially inwards from the outer surface. The shifting tool may also include first and second piston keys located within the first and second key bores wherein each of the first and second piston keys has sleeve engaging surface thereon spaced apart by a distance selected to retain the sleeve therebetween. Each of the first and second piston keys may be operably connected to the actuating piston so as to be extended from the outer surface when the central bore is supplied with a pressurized fluid.

The first and second piston keys and the actuating piston may be each operably connected to a common shaft with arms extending from the shaft. The shaft and the arms may be contained within a chamber in the body. The chamber may be in fluidic communication with the outer surface of the body through a balancing bore. The balancing bore may include a filter therein. The shaft may be biased to urge the first and second piston keys to a retracted position. The shaft may be biased by at least one spring biasing a spring arm extending from the shaft. The spring may be located within a spring bore extending from the outer surface of the body and is compressed between the spring arm and an adjusting cap located within the spring bore. The adjusting cap may be threadably located within the spring bore.

The central passage may include at least one annular groove therein corresponding to a desired position of the sleeve valve wherein the sleeve includes a retaining ring disposed there around receivable within the at least one annular groove. The retaining ring may comprise a split ring surrounding the sleeve having a radially biasing spring between the split ring and the sleeve. The split ring and the radially biasing spring may be located within an annular groove around the sleeve. The annular groove may include sloped sidewalls and wherein the radially biasing spring has a biasing force selected to be retained within the annular groove once a predetermined displacing force has been applied to the tool string.

According to a further embodiment of the present invention there is disclosed a method of controlling fluid flow through a well comprising providing a tubular body inline within the well, the tubular body extending between first and second ends and having a central passage extending therebetween, the first and second ends being connectable to the well assembly such that the central passage is in fluidic communication with an interior of the well assembly. The method further comprises engaging a shifting tool upon a sleeve located within the tubular body and longitudinally displacing the shifting tool relative to the tubular body so as to selectably uncover at least one set of passages extending through the tubular body.

According to a further embodiment of the present invention there is disclosed a method for hydraulically fracturing a soil formation at a zone surrounding a well liner comprising locating a tool string with a shifting tool at a distal end thereof within a tubular body of the well liner, engaging the shifting tool upon a sleeve corresponding to the zone, longitudinally displacing the tool string so as to uncover at least one set of passages extending through the tubular body and pumping a fracturing fluid down an annulus formed between the tool string and the well liner. The annulus may substantially unobstructed.

According to a further embodiment of the present invention there is disclosed a method for hydraulically fracturing a soil formation at a zone surrounding a well liner comprising locating a tool string with a shifting tool at a distal end thereof within a tubular body of the well liner, engaging the shifting tool upon a sleeve corresponding to the zone and longitudinally displacing the tool string so as to uncover at least one set of passages extending through the tubular body. The method further comprises pumping a fracturing fluid down the tool string and releasing the fracturing fluid from the tool string into an annulus formed between the tool string and the well liner through a valve.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
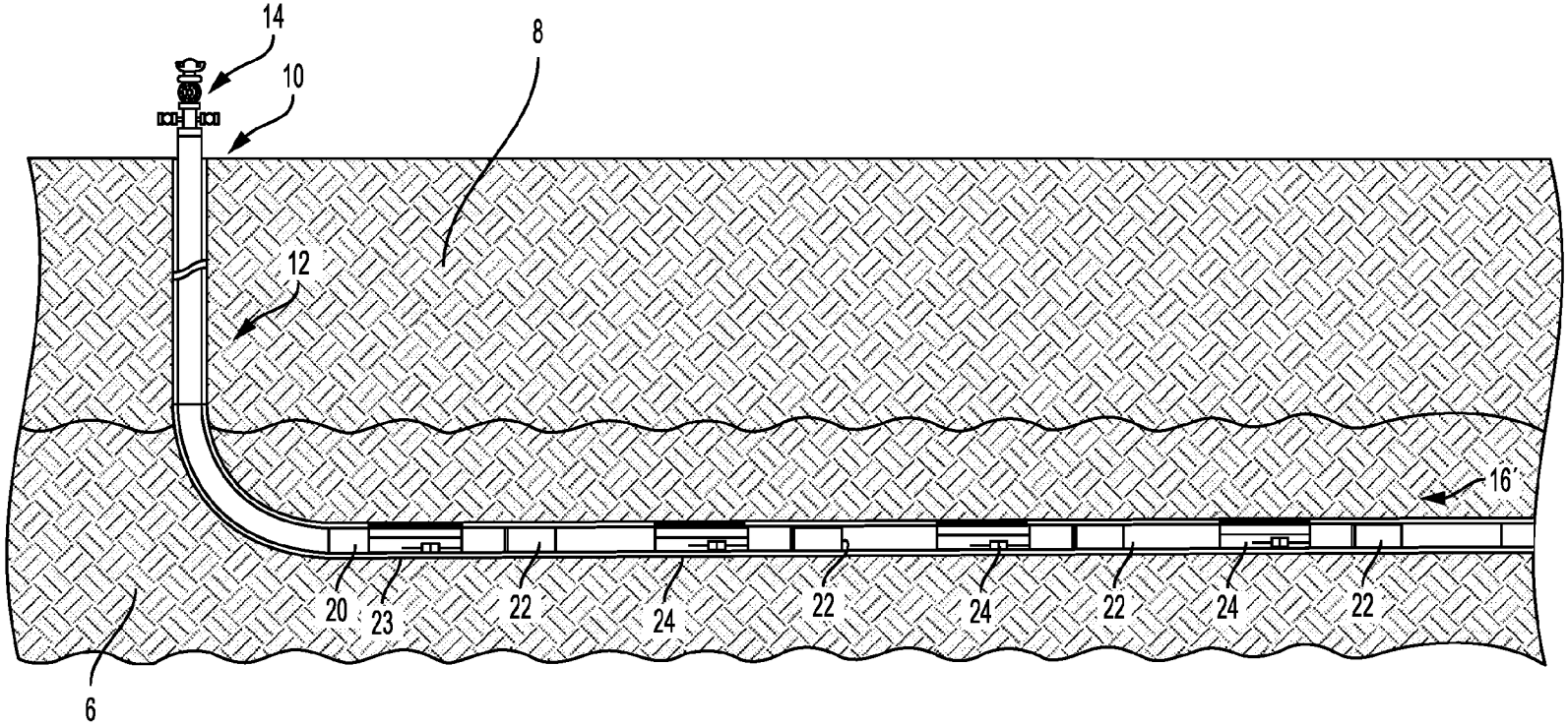
FIG. 1 is a cross-sectional view of a wellbore having a plurality of flow control valves according to a first embodiment of the present invention located therealong.

Referring to FIG. 1, a wellbore 10 is drilled into the ground 8 to a production zone 6 by known methods. The production zone 6 may contain a horizontally extending hydrocarbon bearing rock formation or may span a plurality of hydrocarbon bearing rock formations such that the wellbore 10 has a path designed to cross or intersect each formation. As illustrated in FIG. 1, the wellbore includes a vertical section 12 having a valve assembly or Christmas tree 14 at a top end thereof and a bottom or production section 16 which may be horizontal or angularly oriented relative to the horizontal located within the production zone 6. After the wellbore 10 is drilled the production tubing 20 is of the hydrocarbon well is formed of a plurality of alternating liner or casing 22 sections and in line valve bodies 24 surrounded by a layer of cement 23 between the casing and the wellbore. The valve bodies 24 are adapted to control fluid flow from the surrounding formation proximate to that valve body and may be located at predetermined locations to correspond to a desired production zone within the wellbore. In operation, between 8 and 100 valve bodies may be utilized within a wellbore although it will be appreciated that other quantities may be useful as well.

Figure 2:
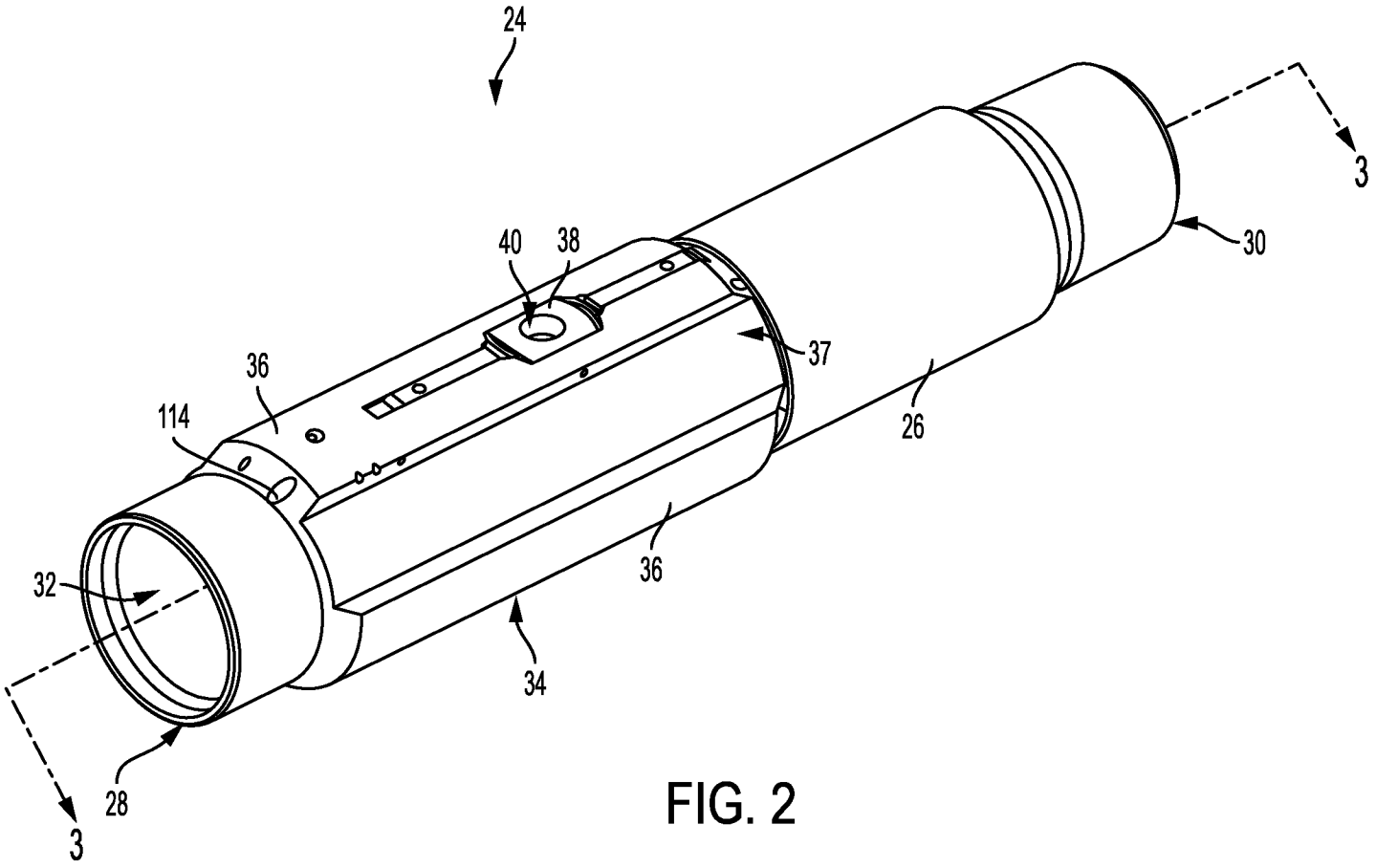
FIG. 2 is a perspective view of one of the control valves of FIG. 1.

Turning now to FIG. 2, a perspective view of one valve body 24 is illustrated. The valve body 24 comprises a substantially elongate cylindrical outer casing 26 extending between first and second ends 28 and 30, respectively and having a central passage 32 therethrough. The first end 28 of the valve body is connected to adjacent liner or casing section 22 with an internal threading in the first end 28. The second end 30 of the valve body is connected to an adjacent casing section with external threading around the second end 30. The valve body 24 further includes a central portion 34 having a plurality of raised sections 36 extending axially therealong with passages 37 therebetween. As illustrated in the accompanying figures, the valve body 24 has three raised sections although it will be appreciated that a different number may also be utilized.

Each raised section 36 includes a port body 38 therein having an aperture 40 extending therethrough. The aperture 40 extends from the exterior to the interior of the valve body and is adapted to provide a fluid passage between the interior of the bottom section 16 and the wellbore 10 as will be further described below. The aperture 40 may be filled with a sealing body (not shown) when installed within a bottom section 16. The sealing body serves to assist in sealing the aperture until the formation is to be fractured and therefore will have sufficient strength to remain within the aperture until that time and will also be sufficiently frangible so as to be fractured and removed from the aperture during the fracking process. Additionally, the port bodies 38 are radially extendable from the valve body so as to engage an outer surface thereof against the wellbore 10 so as to center the valve body 24 and thereby the production section within the wellbore.

Figure 3:
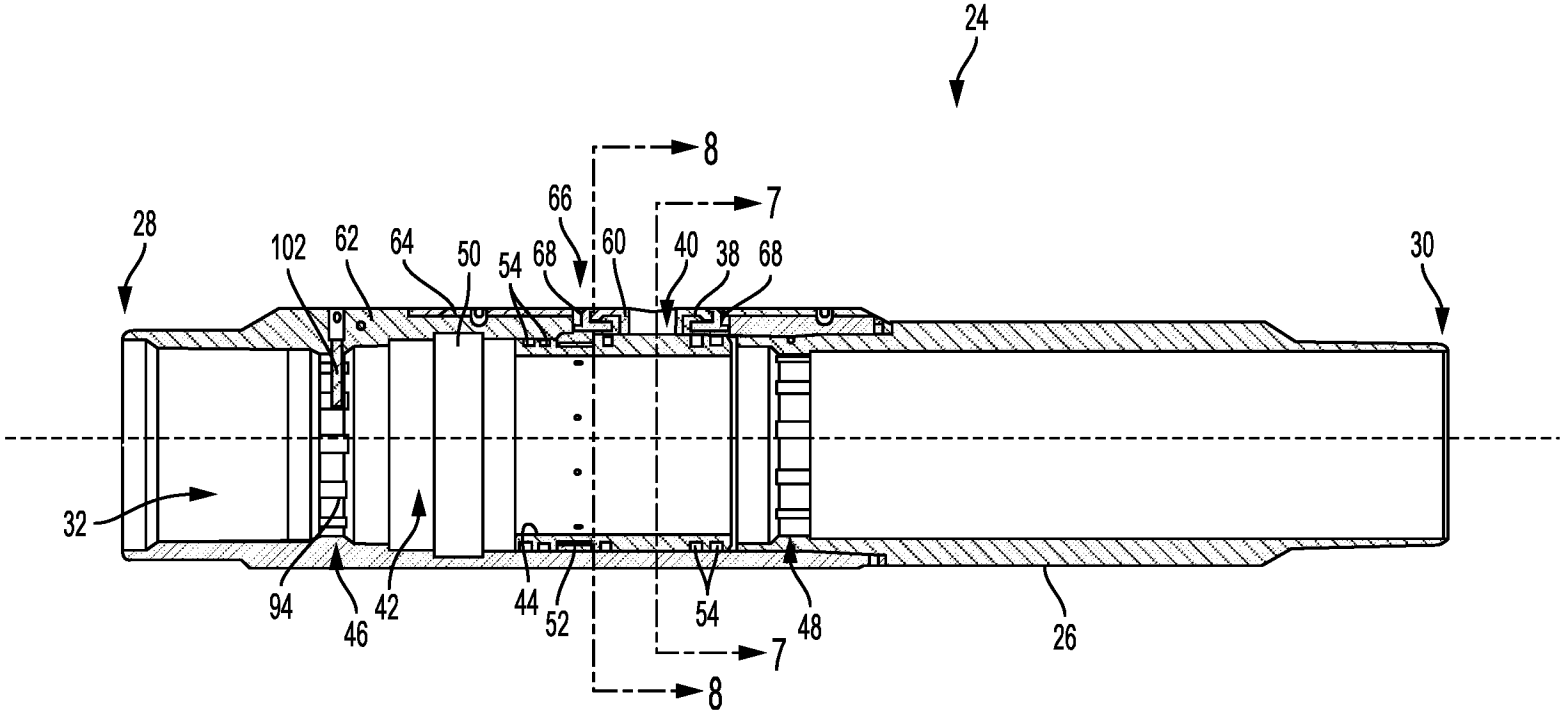
FIG. 3 is a longitudinal cross-sectional view of the control valve of FIG. 2 as taken along the line 3-3.

Turning now to FIG. 3, a cross sectional view of the valve body 24 is illustrated. The central passage 32 of the valve body includes a central portion 42 corresponding to the location of the port bodies 38. The central portion is substantially cylindrical and contains a sliding sleeve 44 therein. The central portion 42 is defined between first or entrance and second or exit raised portions or annular shoulders, 46 and 48, respectively. The sliding sleeve 44 is longitudinally displaceable within the central portion 42 to either be adjacent to the first or second shoulder 46 or 48. At a location adjacent to the second shoulder, the sliding sleeve 44 sealably covers the apertures 40 so as to isolate the interior from the exterior of the bottom section 16 from each other, whereas when the sliding sleeve 44 is adjacent to the first shoulder 46, the sliding sleeve 44

Figure 4:
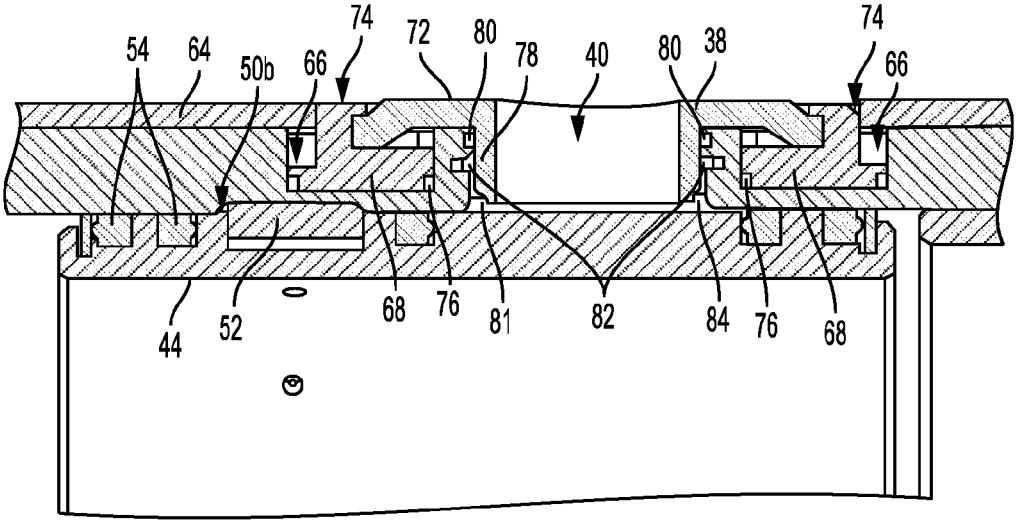
FIG. 4 is a detailed cross-sectional view of the extendable ports of the valve of FIG. 2 in a first or retracted position.
Figure 5:
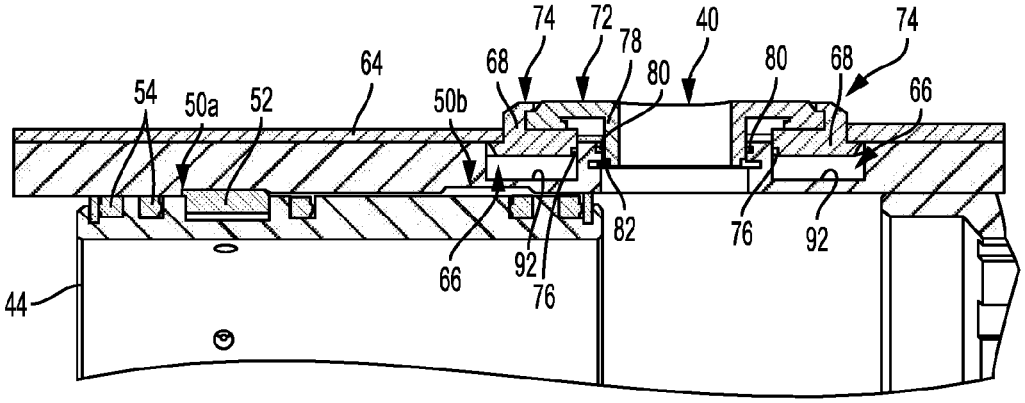
FIG. 5 is a detailed cross-sectional view of the extendable ports of the valve of FIG. 2 in a second or extended position with the sleeve valve in an open position.

The central portion 42 includes a first annular groove 50*a* therein proximate to the first shoulder 46. The sliding sleeve 44 includes a radially disposed snap ring 52 therein corresponding to the groove 50*a* so as to engage therewith and retain the sliding sleeve 44 proximate to the first shoulder 46 which is an open position for the valve body 24. The central portion 42 also includes a second annular groove 50*b* therein proximate to the aperture 40 having a similar profile to the first annular groove 50*a*. The snap ring 52 of the sleeve is receivable in either the first ore second annular groove 50*a* or 50*b* such that the sleeve is held in either an open position as illustrated in FIG. 5 or a closed position as illustrated in FIG. 4. The sliding sleeve 44 also includes annular wiper seals 54 which will be described more fully below proximate to either end thereof to maintain a fluid tight seal between the sliding sleeve and the interior of the central portion 42.

The port bodies 38 are slidably received within the valve body 24 so as to be radially extendable therefrom. As illustrated in FIG. 3, the port bodies are located in their retracted position such that an exterior surface 60 of the port bodies is aligned with an exterior surface 62 of the raised sections 36. Each raised section may also include limit plates 64 located to each side of the port bodies 38 which overlap a portion of and retain pistons within the cylinders as are more fully described below.

Each raised section 36 includes at least one void region or cylinder 66 disposed radially therein. Each cylinder 66 includes a piston 68 therein which is operably connected to a corresponding port body 38. Turning now to FIGS. 4 and 5, detailed views of one port body 38 are illustrated at a retracted and extended position, respectively. Each port body 38 may have an opposed pair of pistons 68 associated therewith arranged to opposed longitudinal sides of the valve body 24. It will be appreciated that other quantities of pistons 68 may also be utilized for each port body 38 as well. The pistons 68 are connected to the valve body by a top plate 70 having an exterior surface 72. The exterior surface 72 is positioned to correspond to the exterior surface 62 of the raised sections 36 so as to present a substantially continuous surface therewith when the port bodies 38 are in their retracted positions. The exterior surface 72 also includes angled end portions 74 so as to provide a ramp or inclined surface at each end of the port body 38 when the port bodies 38 are in an extended position. This will assist in enabling the valve body to be longitudinally displaced within a wellbore 10 with the vertical section 12 under thermal expansion of the production string and thereby to minimize any shear stresses on the port body 38.

The pistons 68 are radially moveable within the cylinders relative to a central axis of the valve body so as to be radially extendable therefrom. In the extended position illustrated in FIG. 5, the exterior surface 72 of the port bodies are adapted to be in contact with the wellbore 10 so as to extend the port body 38 and thereby enable the wellbore 10 to be placed in fluidic communication with the central portion 42 of the valve body 24. The pistons 68 may have a travel distance between their retracted positions and their extended positions of between 0.10 and 0.50 inches although it will be appreciated that other distances may also be possible. In the extended position, it will be possible to frack that location without having to also fracture the concrete which will be located between the valve body 24 and the wellbore wall thereby reducing the required frack pressure. Additionally, more than one port body 38 may be utilized and radially arranged around the valve body so as to centre the valve body within the wellbore when the port bodies are extended therefrom.

The pistons 68 may include seals 76 therearound so as to seal the piston within the cylinders 66. Additionally, the port body 38 may include a port sleeve 78 extending radially inward through a corresponding port bore 81 within the valve body. A seal 80 may be located between the port sleeve 78 and the port bore 81 so as to provide a fluid tight seal therebetween. A snap ring 82 may be provided within the port bore 81 adapted to bear radially inwardly upon the port sleeve 78. In the extended position, the snap ring 82 compresses radially inwardly to provide a shoulder upon which the port sleeve 78 may rest so as to prevent retraction of the port body 38 as illustrated in FIG. 5.

Figure 6:
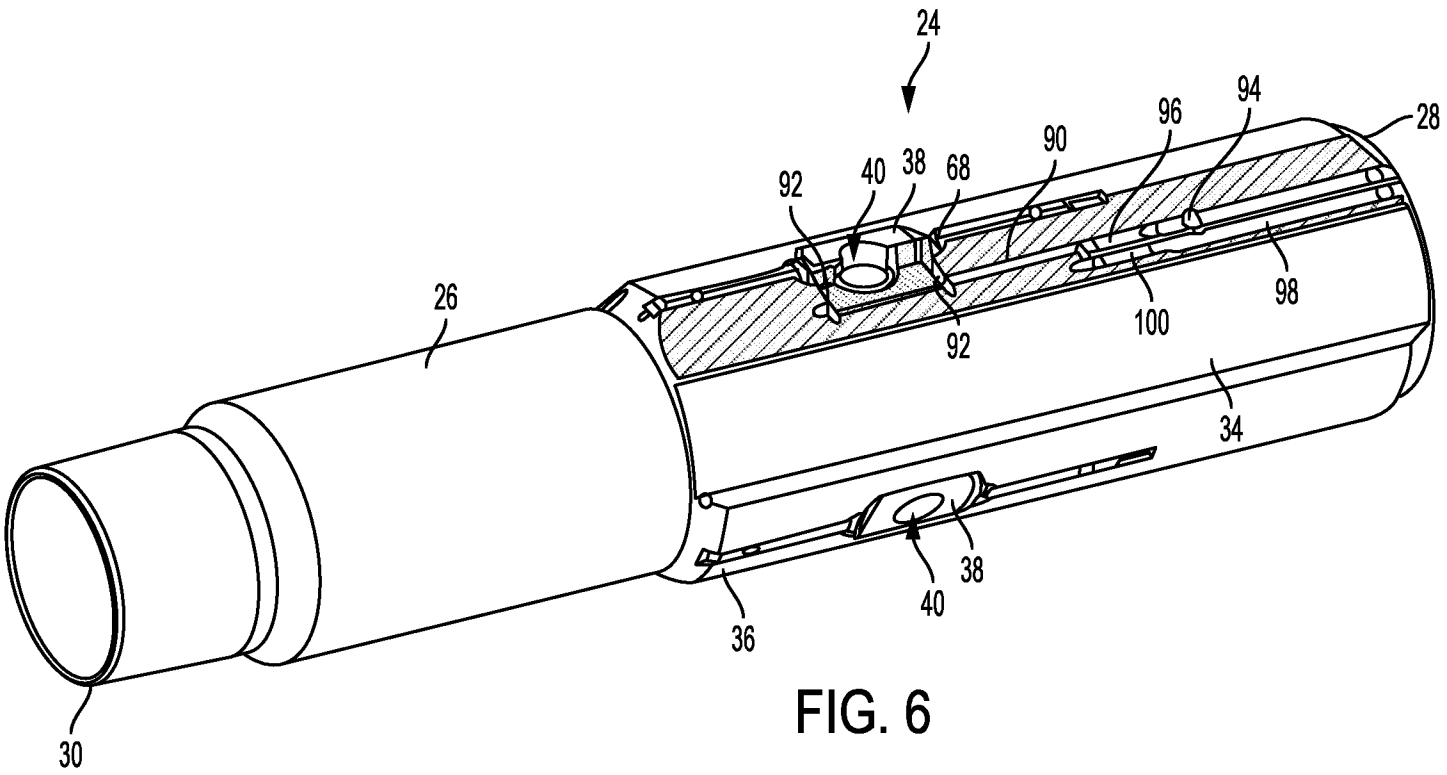
FIG. 6 is a partial cross-sectional view of one raised portion of the valve body of FIG. 2 illustrating a fluid control system.
Figure 8:
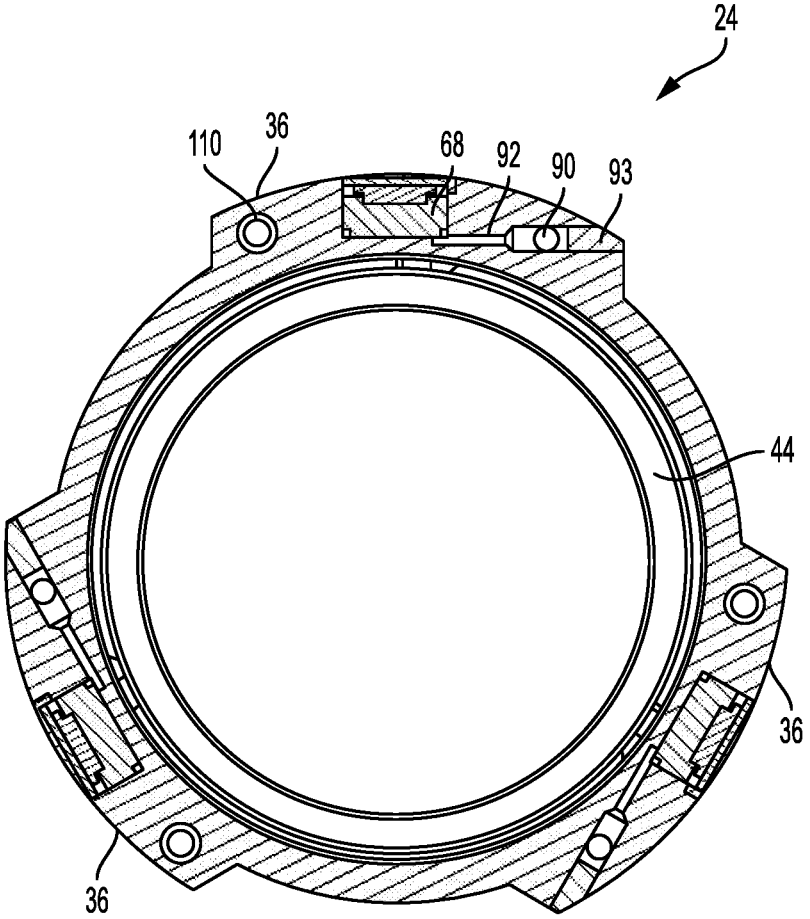
FIG. 8 is an axial cross-sectional view of the control valve of FIG. 3 as taken along line 8-8.

The pistons 68 may be displaceable within the cylinders 66 by the introduction of a pressurized fluid into a bottom portion thereof. As illustrated in FIG. 6, a fluid control system is illustrated for providing a pressurized fluid to the bottom portion of the cylinder 66 from the interior of the valve body 24. In this way a fluid pumped down the center of the bottom section 16 may be utilized to extend the port bodies 38. The fluid control system comprises a fluid bore 90 extending longitudinally within the raised section 36 between an entrance bore 94 and a pair of spaced apart piston connection bores 92. The piston connection bores 92 intersect the bottom portion of the cylinders 66 while the entrance bore extends to the central passage 32 of the valve body 24. The fluid bore 90 may include a relief check valve 96 located therein so as to only pressurize the cylinders 66 when a fluid of a sufficient pressure has been pumped down the production string. In operation, a user may select a check valve 96 of the desired actuation pressure which may be between 500 and 2000 pounds per square inch (psi) with a pressure of between 1000 and 1200 being particularly useful. Other pressures may also be selected which are sufficient to centralize the valve body 24 within the wellbore. This pressure may be referred to as an extension pressure. The fluid control system also includes a relieve bore 98 extending from the fluid bore 90 to an exterior of the valve body 24. As illustrated in FIG. 8, the piston connection bores 92 may be formed by boring into the raised section 36 so as to intersect both the fluid bore 90 and the cylinder 66 and thereafter filing the exterior portion of the piston connection bores with a piston connection plug 93 or the like.

The relief bore 98 includes a relief check valve 100 therein and is adapted to relieve the pressure within the fluid control system and to ensure that the pressure therein as well as within the bottom portion of the cylinders 66 does not reach a pressure which may cause damage to apparatus. In particular, as the extension pressure will be typically selected to be below the pressure required to fracture the formation, or the frack pressure, it will be necessary to ensure that such a higher frack pressure does not rupture the cylinder when it is applied to the interior of the bottom section 16. Frack pressures are known to often be 10,000 psi or higher and therefore the relief check valve 100 may be selected to have a opening pressure of between 5,000 and 8,000 psi.

With reference to FIG. 3, the entrance bore 94 intersect the central passage 32 of the valve body 24. As illustrated each entrance bore 94 may be covered by a knock-out plug 102 so as to seal the entrance bore until removed. In operation, as concrete is pumped down the bottom section 16, it will be followed by a plug so as to provide an end to the volume of concrete. The plug is pressurized by a pumping fluid (such as water, by way of non-limiting example) so as to force the concrete down the production string and thereafter to be extruded into the annulus between the horizontal section and the wellbore. The knock-out plugs 102 are designed so as to be removed or knocked-out of the entrance bore by the concrete plug passing thereby. In such a way, once the concrete has passed the valve body 24, the concrete plug removes the knock-out plugs 102 so as to pressurize the entrance bore 94 and fluid bore 90 and thereafter to extend the pistons 68 from the valve body 24 once the pressurizing fluid has reached a sufficient pressure.

Figure 7:
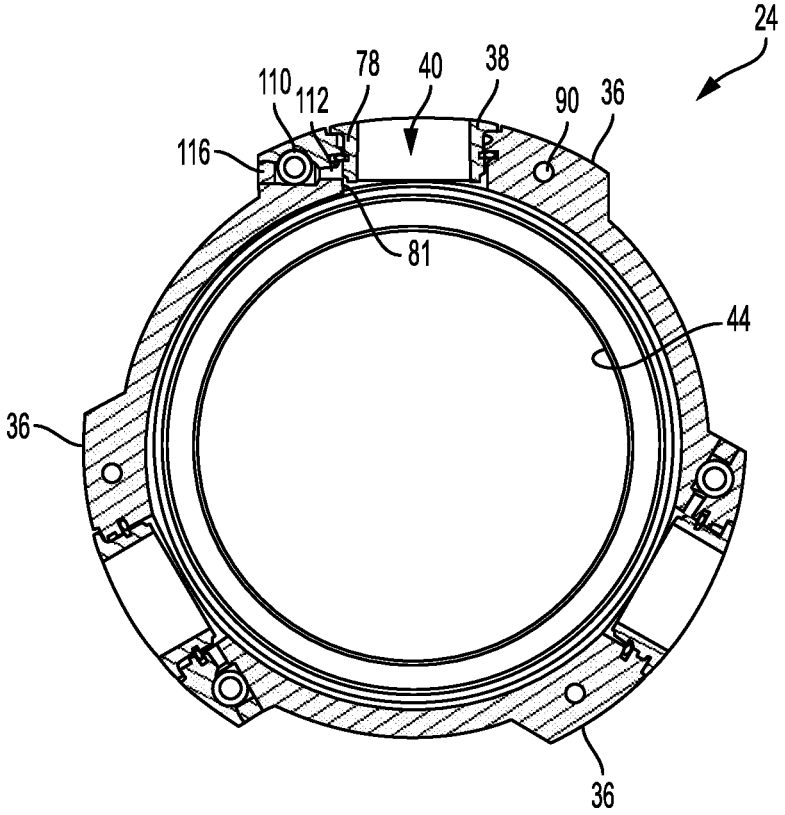
FIG. 7 is an axial cross-sectional view of the control valve of FIG. 3 as taken along line 7-7.

With reference to FIGS. 7 and 8, axial cross-sectional view of the valve body 24 is illustrated through the center of the aperture 40 and port body 38 and through the center of the pistons 68, respectively. Each raised section 36 includes a balancing bore 110 extending therealong substantially parallel to the central axis of the valve body 24. The balancing bore 110 extending between and entrance end 114 (shown on FIG. 2) and a connection bore 112 extending to the port bore 81. The balancing bore 110 may include a piston therein and be pre-filled with a fluid such as oil, by way of non-limiting example. In operation, the balancing bore 110 balances the pressure within the bore port 81 as the port body 38 is extended from the valve body 24. In particular, as the port body 38 is extended from the valve body, a negative pressure will be created within the space between the closed sliding sleeve 44 and the sealing body (not shown) located within the aperture 40 as this space is increased in volume. The balancing bore 110 reduces this negative pressure by providing an additional fluid contained therein to be drawn into the port bore 81 to fill this volume and balance the pressure therein with the pressures to the exterior of the valve body 24. As illustrated in FIG. 7, the connection bore 112 may be formed by boring into the raised section 36 so as to intersect both the balancing bore 110 and the port bore 81 and thereafter filing the exterior portion of the connection bore with a plug 116 or the like.

Figure 9:
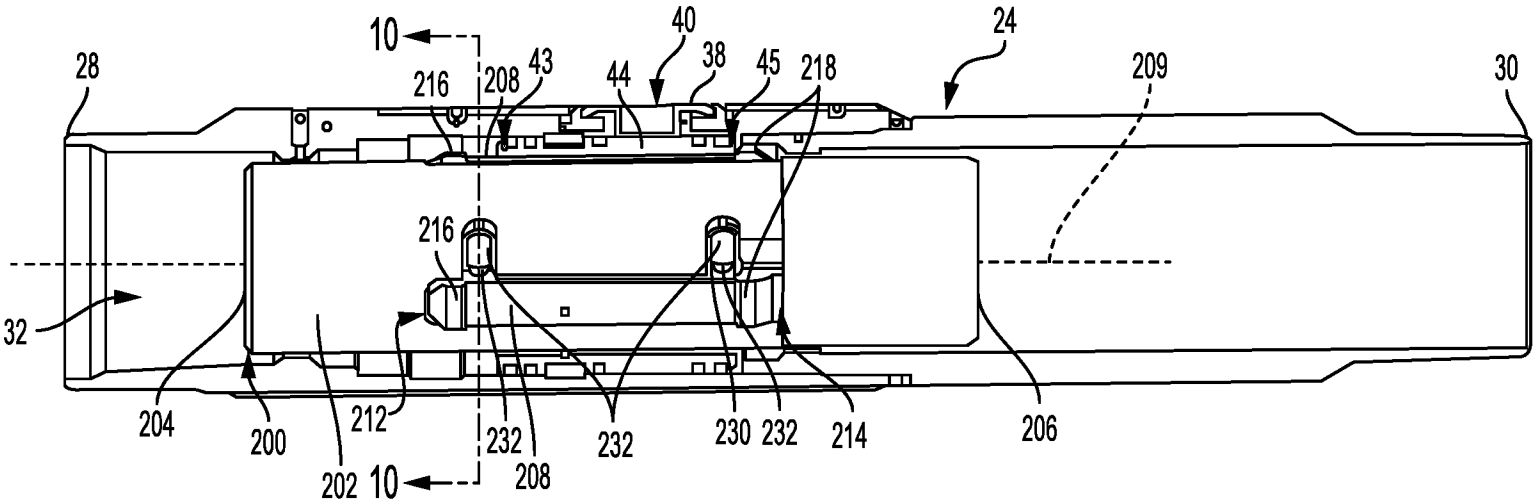
FIG. 9 is a cross sectional view of the valve of FIG. 2 as taken along the line 3-3 showing a shifting tool located therein.

Turning now to FIG. 9, a shifting tool 200 is illustrated within the central passage 32 of the valve body 24. The shifting tool 200 is adapted to engage the sliding sleeve 44 and shift it between a closed position as illustrated in FIG. 9 and an open position in which the apertures 40 are uncovered by the sliding sleeve 44 so as to permit fluid flow between and interior and an exterior of the valve body 24 as illustrated in FIG. 5. The shifting tool 200 comprises a substantially cylindrical elongate tubular body 202 extending between first and second ends 204 and 206, respectively. The shifting tool 200 includes a central bore 210 therethrough (shown in FIGS. 10 through 12) to receive an actuator or to permit the passage of fluids and other tools therethrough. The shifting tool 200 includes at least one sleeve engaging member 208 radially extendable from the tubular body 202 so as to be selectably engageable with the sliding sleeve 44 of the valve body 24. As illustrated in the accompanying figures, three sleeve engaging members 208 are illustrated although it will be appreciated that other quantities may be useful as well.

Figure 11:
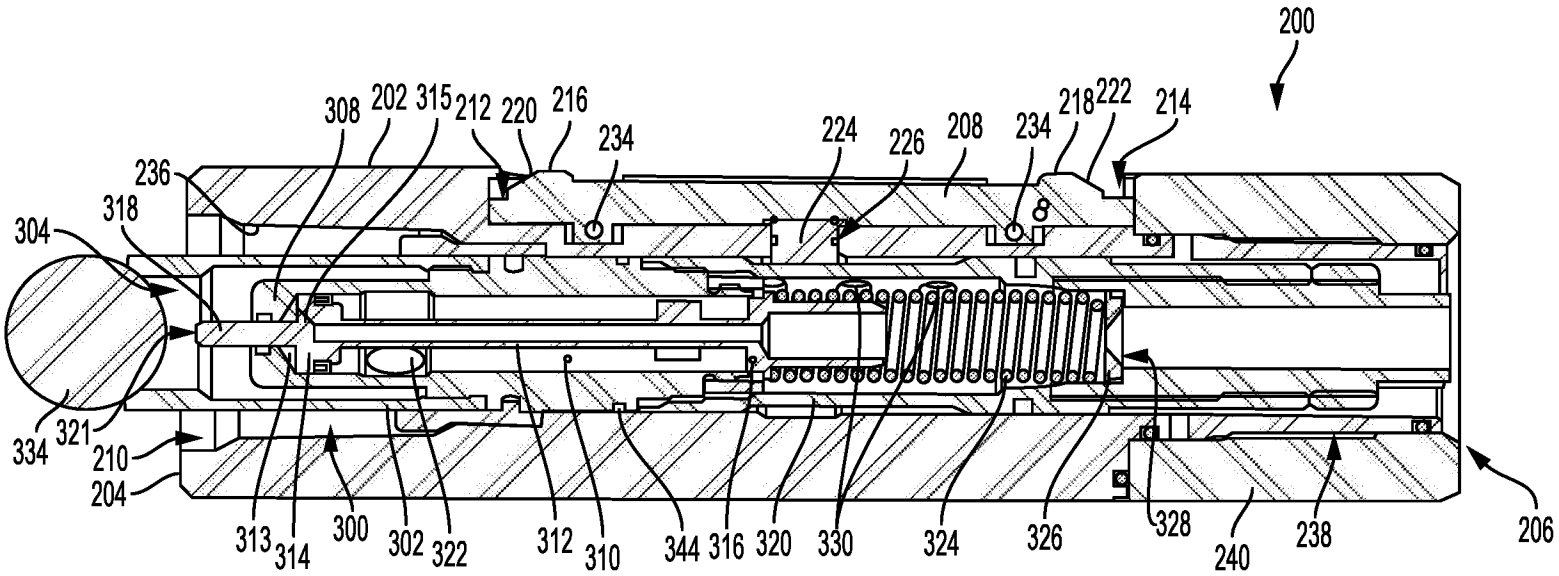
FIG. 11 a lengthwise cross sectional view of the shifting tool of FIG. 9 taken along the line 11-11 in FIG. 10 with a control valve located therein according to one embodiment with the sleeve engaging members located at a first or retracted position.
Figure 12:
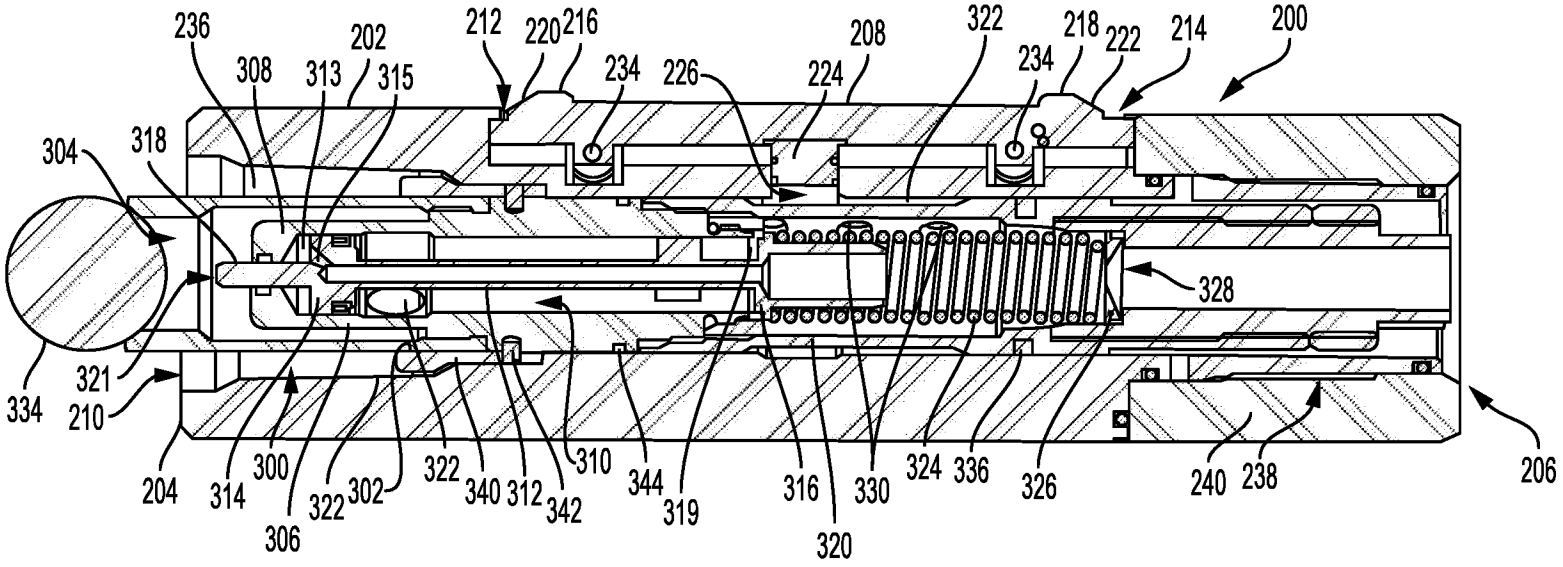
FIG. 12 is a cross sectional view of the shifting tool of FIG. 9 taken along the line 11-11 with a control valve located therein according to one embodiment with the sleeve engaging members located at a second or extended position.
Figure 17:
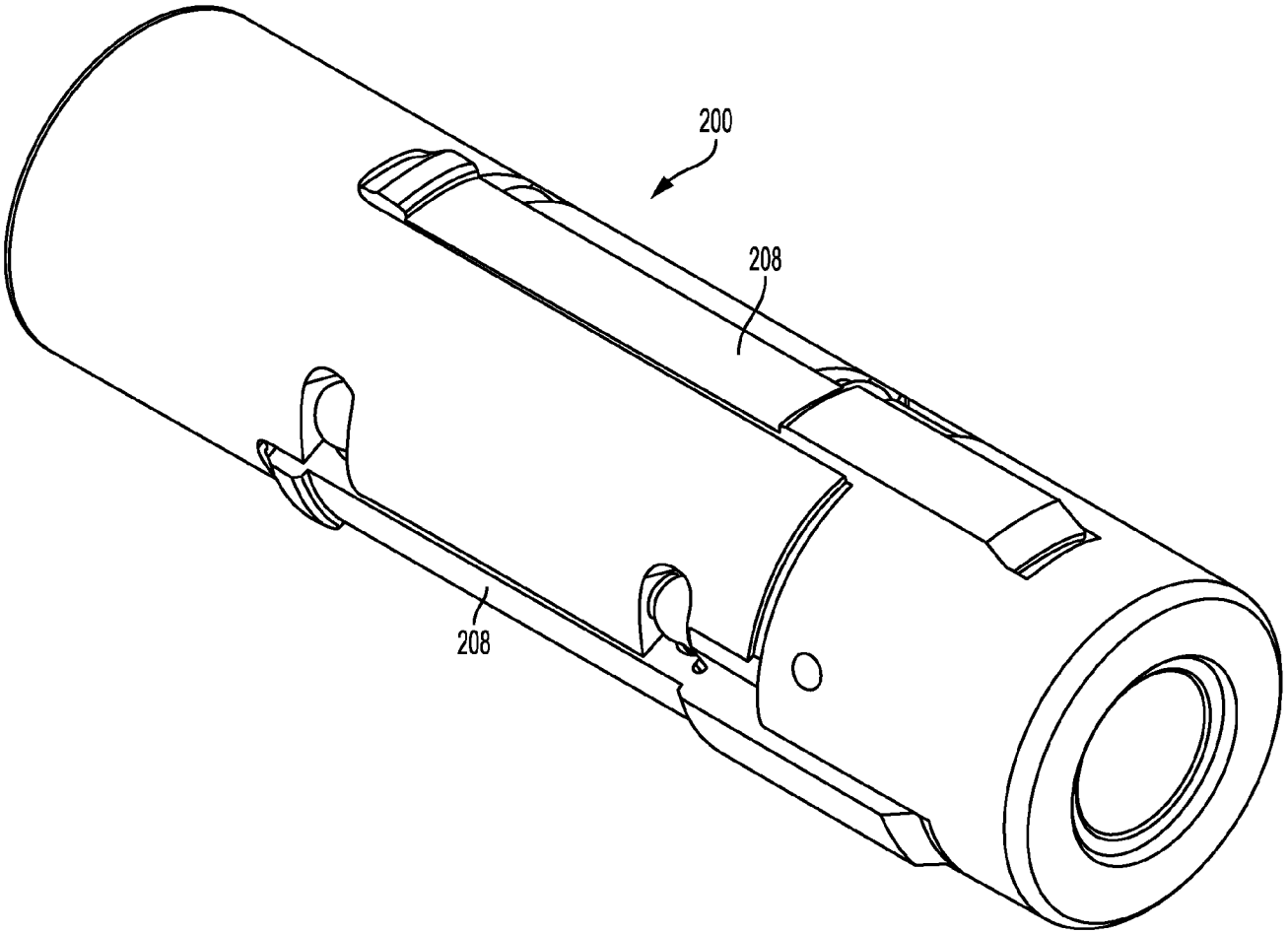
FIG. 17 is a perspective view of a shifting tool according to a further embodiment.
Figure 18:
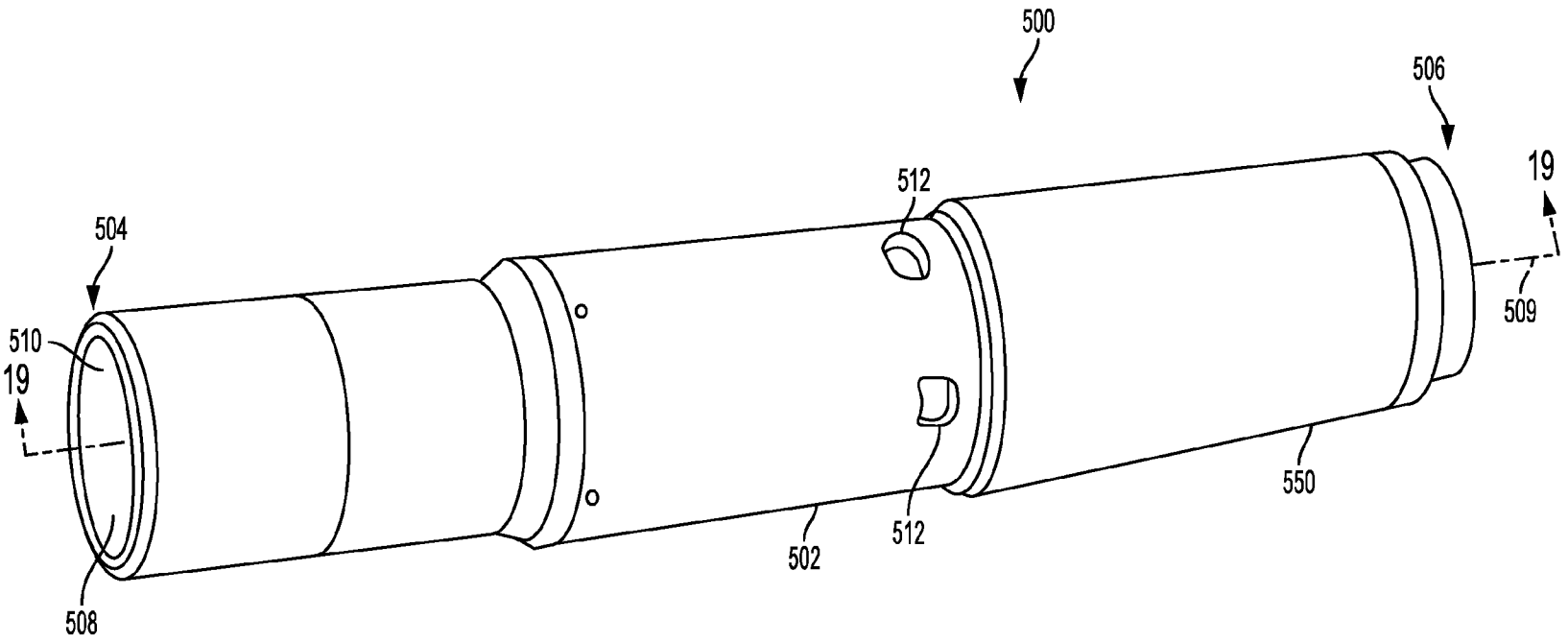
FIG. 18 is a perspective view of a control valve according to a further embodiment of the present invention.

The sleeve engaging members 208 comprise elongate members extending substantially parallel to a central axis 209 of the shifting tool between first and second ends 212 and 214, respectively. The first and second ends 212 and 214 include first and second catches 216 and 218, respectively for surrounding the sliding sleeve and engaging a corresponding first or second end 43 or 45, respectively of the sliding sleeve 44 depending upon which direction the shifting tool 200 is displaced within the valve body 24. As illustrated in FIGS. 11 and 12, the first and second catches 216 and 218 of the sleeve engaging member 208 each include and inclined surface 220 and 222, respectively facing in opposed directions from each other. The inclined surfaces 220 and 222 are adapted to engage upon either the first or second annular shoulder 46 or 48 of the valve body as the shifting tool 200 is pulled or pushed there into. The first or second annular shoulders 46 or 48 press the first or second inclined surface 220 or 222 radially inwardly so as to press the sleeve engaging members 208 inwardly and thereby to disengage the sleeve engaging members 208 from the sliding sleeve 44 when the sliding sleeve 44 has been shifted to a desired position proximate to one of the annular shoulders. In an optional embodiment, one or both of the catches 216 or 218 may have an extended length as illustrated in FIG. 17 such that the sleeve engaging members are disengaged from the sliding sleeve at a position spaced apart from one of the first or second annular shoulders 46 or 48 and thereby adapted to position the sliding sleeve at a third or central position within the valve body 24.

Figure 10:
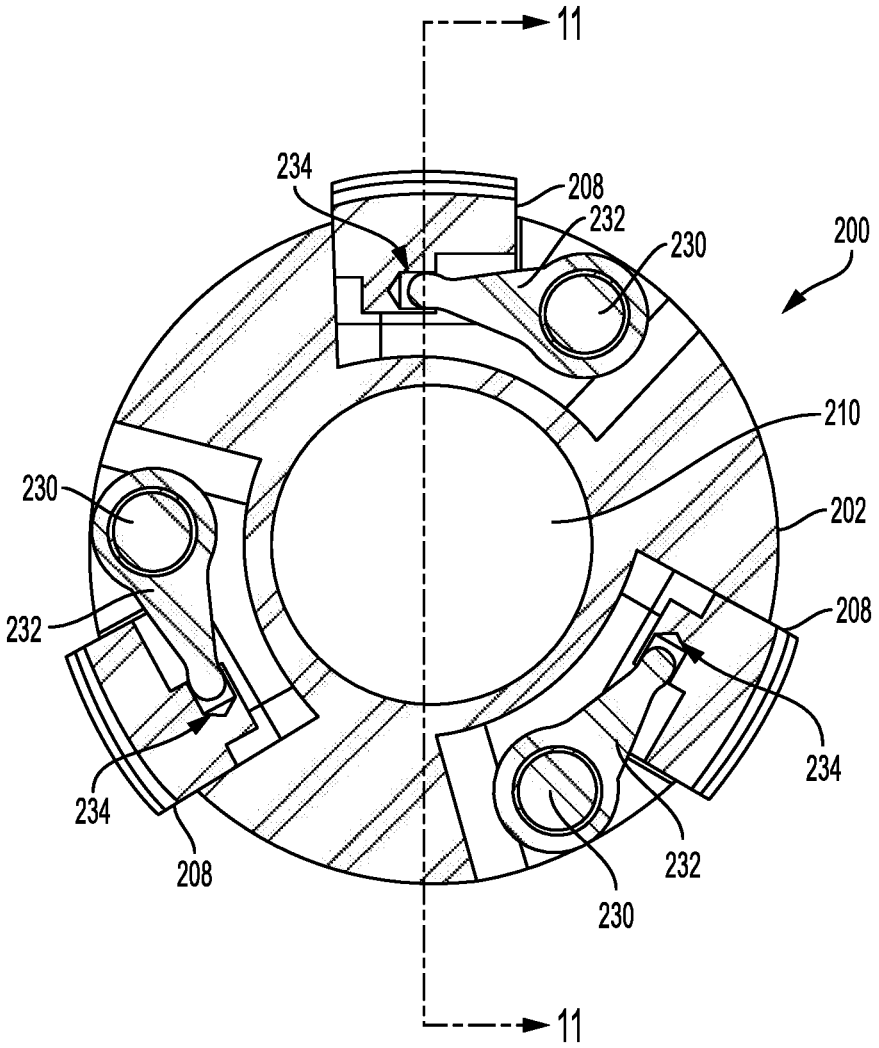
FIG. 10 is an axial cross-sectional view of the shifting tool of FIG. 9 as taken along the line 10-10.

Turning to FIG. 10, the sleeve engaging members are maintained parallel to the tubular body 202 of the shifting tool 200 by a parallel shaft 230. Each parallel shaft 230 is linked to a sleeve engaging member 208 by a pair of spaced apart linking arms 232. The parallel shaft 230 is rotatably supported within the shifting tool tubular body 202 by bearings or the like. The linking arms 232 are fixedly attached to the parallel shaft 230 at a proximate end and are received within a blind bore 234 of the sleeve engaging members 208. As illustrated in FIG. 9, the linking arms 232 are longitudinally spaced apart from each other along the parallel shaft 230 and the sleeve engaging member 208 so as to be proximate to the first and second ends 212 and 214 of the sleeve engaging member 208.

Turning now to FIG. 11, the tubular body 202 of the shifting tool includes a shifting bore 226 therein at a location corresponding to each sleeve engaging member. The shifting bore 226 extends from a cavity receiving the sleeve engaging member to the central bore 210 of the shifting tool 200. Each sleeve engaging member 208 includes a piston 224 extending radially therefrom which is received within the shifting bore 226. In operation, a fluid pressure applied to the central bore 210 of the shifting tool will be applied to the piston 224 so as to extend the piston within the shifting bore 226 and thereby to extend the sleeve engaging members 208 from a first or retracted position within the shifting tool tubular body 202 as illustrated in FIG. 11 to a second or extended position for engagement on the sliding sleeve 44 as discussed above as illustrated in FIG. 12. The parallel shafts also include helical springs (not shown) thereon to bias the sleeve engaging members to the retracted position.

The first end 204 of the shifting tool 200 includes an internal threading 236 therein for connection to the external threading of the end of a production string or pipe (not shown). The second end 206 of the shifting tool 200 includes external threading 238 for connection to internal threading of a downstream productions string or further tools, such as by way of non-limiting example a control valve as will be discussed below. An end cap 240 may be located over the external threading 238 when such a downstream connection is not utilized.

With reference to FIGS. 11 and 12, a first control valve 300 according to a first embodiment located within a shifting tool 200 for use in wells having low hydrocarbon production flow rates. The low flow control valve 300 comprises a valve housing 302 having a valve passage 304 therethrough and seals 344 therearound for sealing the valve housing 302 within the shifting tool 200. The low flow control valve 300 includes a central housing extension 306 extending axially within the valve passage 304 and a spring housing portion 320 downstream of the central portion 310. The central housing extension 306 includes an end cap 308 separating an entrance end of the valve passage from a central portion 310 of the valve passage and an inlet bore 322 permitting a fluid to enter the central portion 310 from the valve passage 304.

The central portion 310 of the valve passage contains a valve piston rod 312 slidably located therein. The valve piston rod 312 includes leading and trailing pistons, 314 and 316, respectively thereon in sealed sliding contact with the central portion 310 of the valve passage. The leading piston 314 forms a first chamber 313 with the end cap 308 having an inlet port 315 extending through the leading piston 314. The valve piston rod 312 also includes a leading extension 318 having an end surface 321 extending from an upstream end thereof and extending through the end cap 308. The valve piston rod 312 is slidable within the central portion 310 between a closed position as illustrated in FIG. 11 and an open position as illustrated in FIG. 12. In the closed position, the second or trailing piston 316 is sealable against the end of the central portion 310 to close or seal the end of the central passage and thereby prevent the flow of a fluid through the control valve. In the open position as illustrated in FIG. 12, the trailing piston 316 is disengagable from the end of the central portion 310 so as to provide a path of flow, generally indicated at 319, therethrough from the central passage to the spring housing.

A spring 324 is located within the spring housing 320 and extends from the valve piston rod 312 to an orifice plate 326 at a downstream end of the spring housing 320. The spring 324 biases the valve piston rod 312 towards the closed position as illustrated in FIG. 11. Shims or the like may be provided between the spring 324 and the orifice plate 326 so as to adjust the force exerted by the spring upon the valve piston rod 312. In other embodiments, the orifice plate may be axially moveable within the valve body by threading or the like to adjust the force exerted by the spring. In operation, fluid pumped down the production string to the valve passage 304 passes through the inlet bore and into the central portion 310. The pressure of the fluid within the central portion 310 is balanced upon the opposed faces of leading and trailing pistons 314 and 316 such that the net pressure exerted upon the valve piston rod 312 is provided by the pressure exerted on the end surface 321 of the leading extension 318 and on the leading piston 314 from within the first chamber 313. The resulting force exerted upon the end surface 321 is resisted by the biasing force provided by the spring 324 as described above.

Additionally, the orifice plate 326 includes an orifice 328 therethrough selected to provide a pressure differential there across under a desired fluid flow rate. In this way, when the fluid is flowing through the central portion 310 and the spring housing 320, the spring housing 320 will have a pressure developed therein due to the orifice plate. This pressure developed within the spring housing 320 will be transmitted through apertures 330 within the spring housing to a sealed region 332 around the spring housing proximate to the shifting bore 226 of the shifting tool 200. This pressure serves to extend the pistons 224 within the shifting bores 226 and thereby to extend the sleeve engaging members 208 from the shifting tool. The pressure developed within the spring housing 320 also resists the opening of the valve piston rod 312 such that in order for the valve to open and remain open, the pressure applied to the entrance of the valve passage 304 is required to overcome both the biasing force of the spring 324 and the pressure created within the spring housing 320 by the orifice 328.

The valve 300 may be closed by reducing the pressure of the supplied fluid to below the pressure required to overcome the spring 324 and the pressured created by the orifice 328 such that the spring is permitted to close the valve 300 by returning the valve piston rod 312 to the closed position as illustrate in 11 as well as permitting the springs on the parallel shaft 230 to retract the sleeve engaging members 208 as the pressure within the spring housing 320 is reduced. Seals 336 as further described below may also be utilized to seal the contact between the spring housing 320 and the interior of the central bore 210 of the shifting tool 200.

A shear sleeve 340 may be secured to the outer surface of the valve housing 302 by shear screws 342 or the like. The sheer sleeve 340 is sized and selected to be retained between a pipe threaded into the internal threading 236 of the shifting tool 200 and the remainder of the shifting tool body. In such a way, should the valve be required to be retrieved, a spherical object 334, such as a steel ball, such as are commonly known in the art may be dropped down the production string so as to obstruct the valve passage 304 of the valve 300. Obstructing the flow of a fluid through the valve passage 304 will cause a pressure to develop above the valve so as to shear the shear screws 342 and force the valve through the shifting tool. The strength of the sheer screws 342 may be selected so as to prevent their being sheered during normal operation of the valve 300 such as for pressures of between 1000 and 3000 psi inlet fluid pressure. The valve illustrated in FIGS. 11 and 12 is adapted for use in a low hydrocarbon flow rate well. In such well types, the flow of fluids such as hydrocarbons or other fluids is low enough that the fluid pumped down the well to pressurize the central portion 310 is sufficient to overcome the flow of the fluids up the well so as to pass through the orifice 328. It will be appreciated that for wells of higher well pressure or flow rates, such a valve will be limited in its application.

Figure 13:
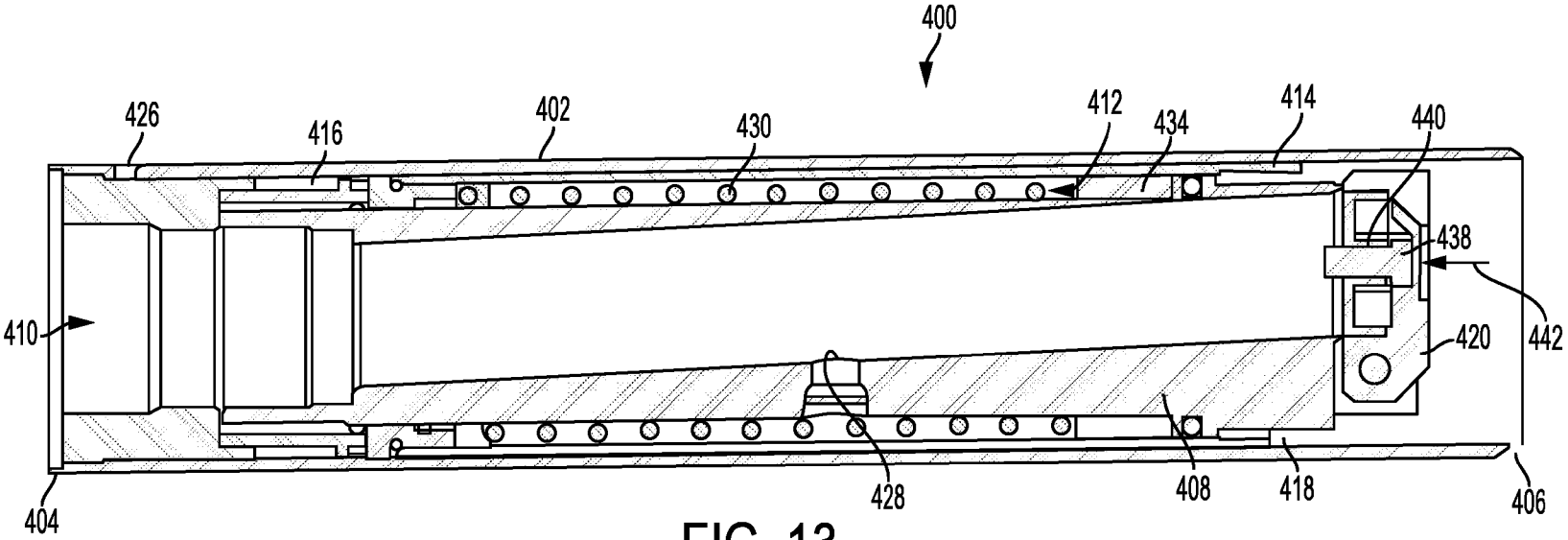
FIG. 13 is a cross sectional view of a control valve according to a further embodiment for actuating the sleeve engaging members at a closed position.
Figure 14:
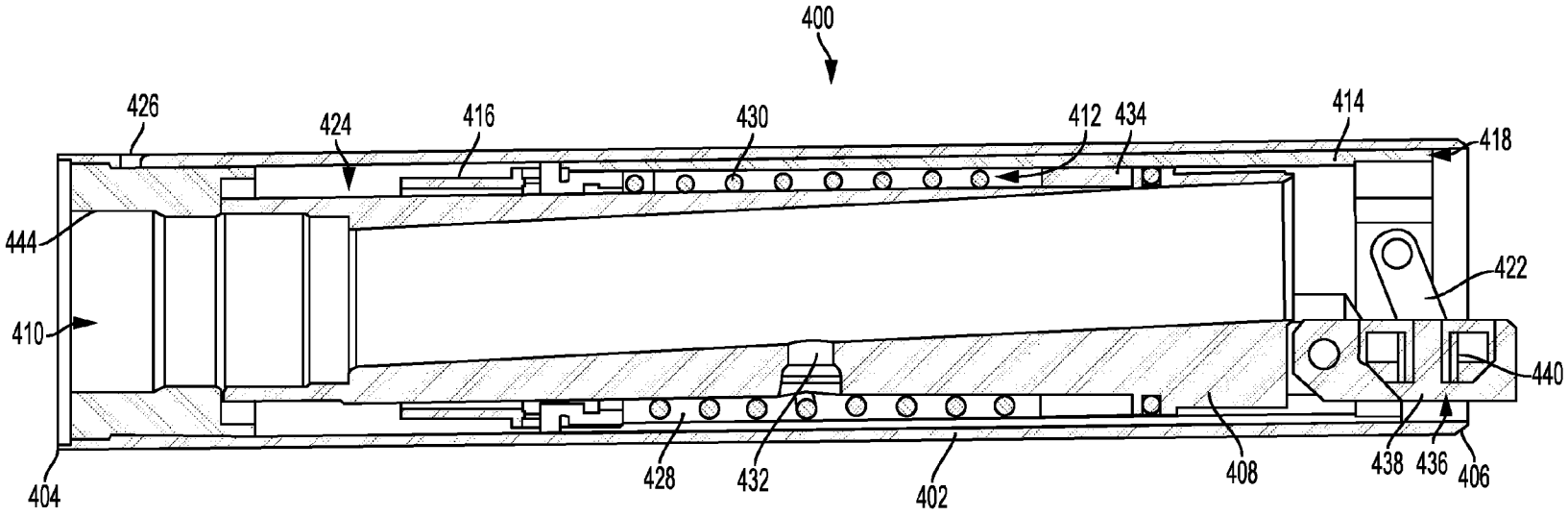
FIG. 14 is a cross sectional view of a control valve according to a further embodiment for actuating the sleeve engaging members at an open position.

Turning now to FIGS. 13 and 14, a second control valve 400 according to a further embodiment located for use in wells having high hydrocarbon production flow rates is illustrated. The high flow control valve 400 comprises an outer tubular body 402 extending between first and second ends 404 and 406, respectively. An inner tubular body 408 is located within the outer tubular body 402 having a central passage 410 therethrough and forming an annular cavity 412 with the outer tubular body. A flap 420 is pivotally connected to a distal end of the inner tubular body 408. The flap 420 selectably closes and seals the central passage 410 as the flap 420 is rotated into a first or closed position as illustrated in FIG. 13. The flap 420 may also be rotated to a second or open position as illustrated in FIG. 14 so as to permit fluids and tools to be passed through second control valve 400.

An elongate longitudinally displaceable sleeve 414 is received within the annular cavity 412. The sleeve 414 includes an annular piston 416 at a first end and a free second end 418. The second end 418 is connected to the flap 420 by a linkage 422 such that when flap 420 is rotated to the open position as illustrated in FIG. 14, the sleeve will be extended towards the second end 406 of the control valve 400. Similarly, when the flap 420 is rotated to the closed position as illustrated in FIG. 13, the sleeve 414 is retracted towards the first end 404.

The annular piston 416 is located within a first end 424 of the annular cavity 412 proximate to the first end 404 of the valve 400. The first end 424 is in fluidic communication with an annulus around the exterior of the outer tubular body 402 and also the distal end of the control valve 400 through a bore hole 426. The annular sleeve 414 is approximately hydrostatically balanced due to the same pressurized fluid from the wellbore being present at the second end 418 of the sleeve as well as upon the annular piston 416 within the first end 424. Biasing the annular piston 416 towards the first end of the control valve 400 is a spring 430 contained within a spring cavity 428 between the annular sleeve 414 and the outer tubular body 402. Additionally a spring cavity 428 may include an internal bore 432 from the central passage 410 so as to port or introduce a fluid into the spring cavity 428 and thereby prevent any fluid contained therein from acting as a further biasing spring. The force exerted upon the annular piston 416 may be adjusted by providing one or more shims 434 at an opposite end of the spring from the annular piston 416.

In a free resting state, the spring 430 biases the piston towards the first end 404 of the control valve and thereby maintains the flap 420 in the closed position. The flap 420 may be opened by pumping a fluid down the production string so as to introduce a pressurized fluid into the central passage thereof. The pressurized fluid forces the flap 420 open as illustrated in FIG. 14 when the flow and pressure of the pressurized fluid is sufficient to overcome the force of the spring 430.

The flap 420 may optionally include a check valve 436 therein comprising a plug 438 compressed into the flap 420 by a spring 440 or the like. When a closed flap 420 experiences a pressure from the bottom of the well greater than the set point of the check valve, the well pressure will displace the plug 438 against the spring 440 in a direction generally indicated at 442 in FIG. 13. This will then open the check valve and permit fluid to flow past the check valve in direction 442. The central passage 410 of the valve also includes internal threading 444 adapted to be threadably secured to the external threading 238 of a shifting tool as described above. In such a connection, it will be appreciated that the end cap 240 of the sleeve engaging member must be removed to permit access to the external threading 238.

In operation, the control valve 400 actuates the sleeve engaging members of the shifting tool by providing a pressurized fluid to the common passage through the shifting tool 200 and the valve 400. When the central passage is pressurized to a sufficient pressure by a fluid pumped down the production string, the fluid from the central passage forces the flap 420 open. Thereafter, the fluid will need to be pumped down the production string at a sufficiently high volume so as to maintain the pressure within the production string at a pressure sufficient to act upon the pistons 224 so as to extend the sleeve engaging members 208.

Figure 15:
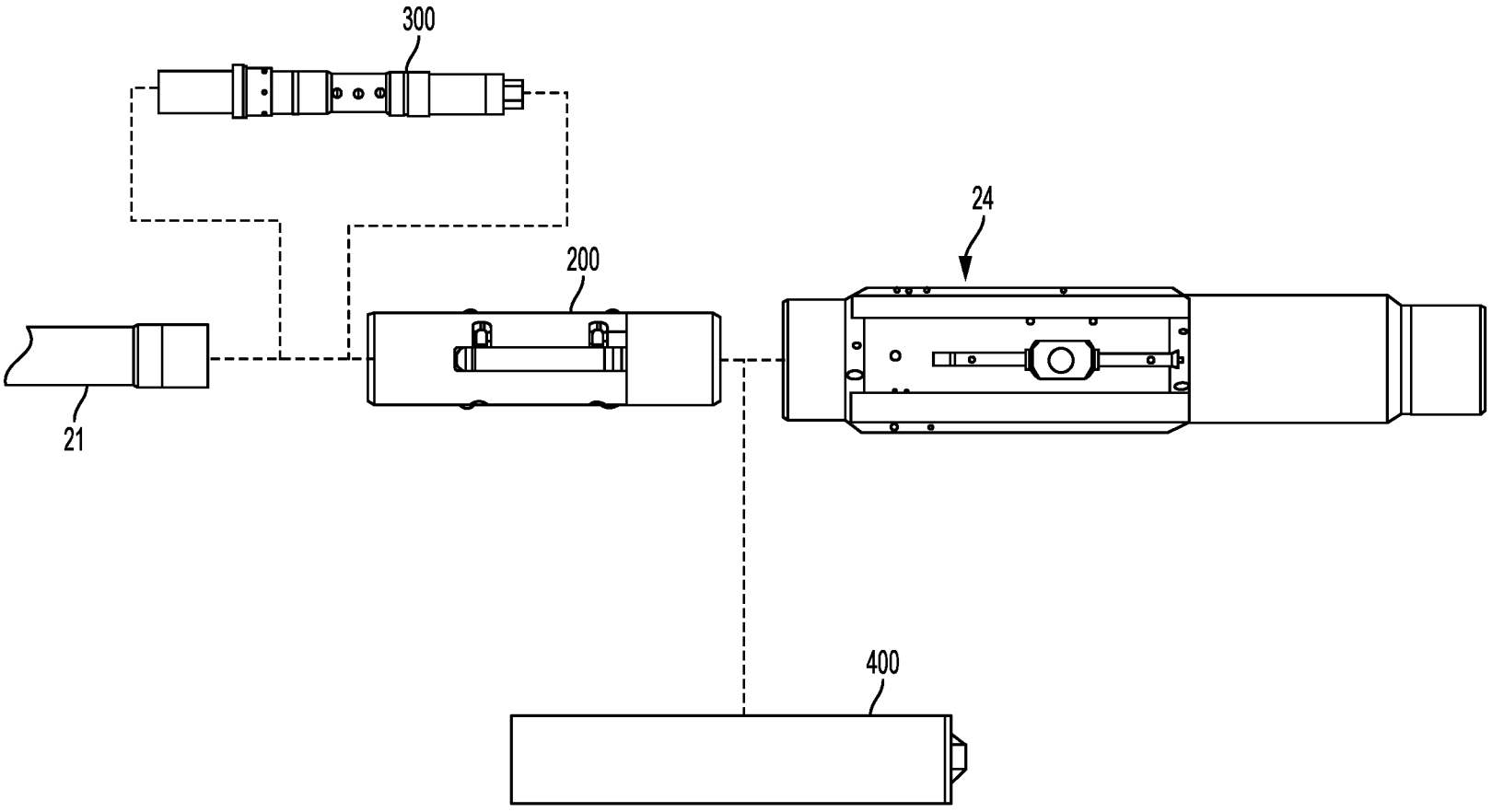
FIG. 15 is a schematic view of a system for controlling fluid flow through a wellbore.

Turning now to FIG. 15, a schematic view of a system according to the present invention is illustrated. The system may include one or more valve bodies 24 located within a bottom section 16 as described above. In operation, a user may extend a shifting tool 200 down the bottom section to shift the sliding sleeve 44 at the end of a production casing 21. The shifting tool 200 may be actuated by either the first valve 300 which is located within the shifting tool 200 or by the second valve 400 which is located to a distal end of the shifting tool.

Figure 16:
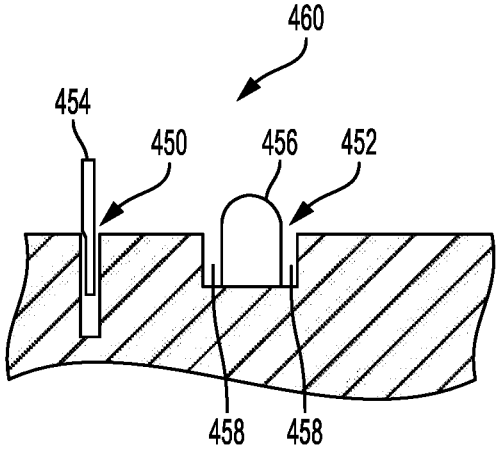
FIG. 16 is a cross sectional view of a seal for use between tool parts in a wellbore.

With reference to FIG. 16, one or more of the seals 460 for use with the above system may comprise first and second spaced apart grooves 450 and 452, respectively. The first groove is sized to receive a wiper 454, such as a radially compressible ring having a gap therein as are commonly known in the art. As illustrated, the wiper 454 may have an uncompressed radius greater than the radius of the first groove 450 so as to provide a radial space into which the wiper may be compressed. The second groove is sized to receive a vulcanized rubber seal 456 therein such that a gap, generally indicated at 458 is left between the seal 456 and the sides of the second groove 452. The top of the seal 456 may be domed such that as the seal encounters an opposed surface (not shown) the seal is pressed down into the second groove to fill the gaps 458. The gaps 458 may have a distance of between 0.010 and 0.50 inches although it will be appreciated that other gap distances may be used as well. When the seal encounters a space in the opposed surfaces, such as for example at a port or the like the seal is permitted to expand to it's uncompressed shape to limit the volume of fluid which may be permitted to pass into the port.

Figure 19:
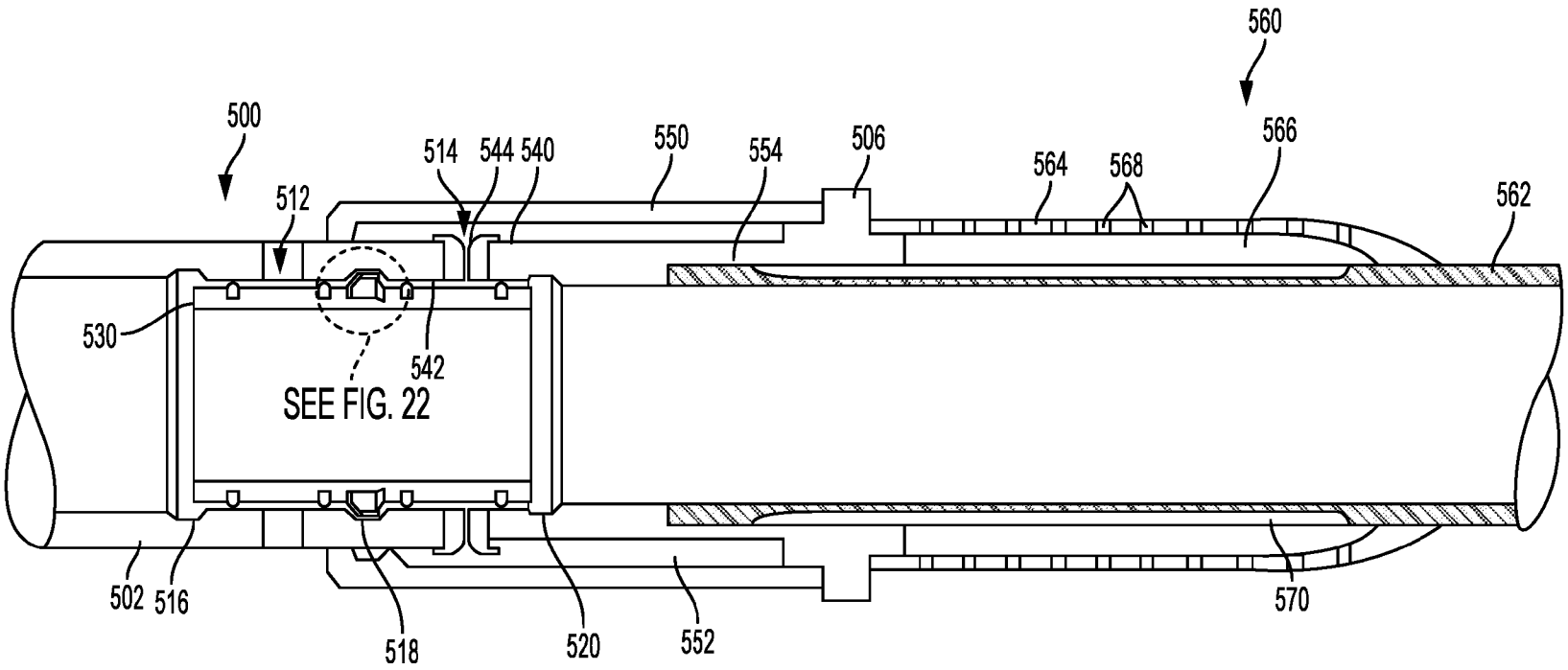
FIG. 19 is a cross sectional view of the control valve of FIG. 18 as taken along the line 19-19 with the sleeve in a first position.

Turning now to FIGS. 18 through 21 a perspective view of a valve body 500 according to a further embodiment of the present invention is illustrated. The valve body 500 comprises a substantially elongate cylindrical outer casing 502 extending between first and second ends 504 and 506, respectively and having a central passage 508 extending therethrough along an axis 509 between the first and second ends 504 and 506. The first end 504 of the valve body is connected to adjacent liner or casing section 22 with internal or external threading 510 in the first end 504. The second end 506 of the valve body 502 is connected to an adjacent filter section with internal threading (as illustrated in FIG. 19) within the second end 506. The valve body 500 further includes first and second sets of ports, 512 and 514, respectively therethrough (only the first set of ports 512 illustrated in FIG. 18).

Figure 20:
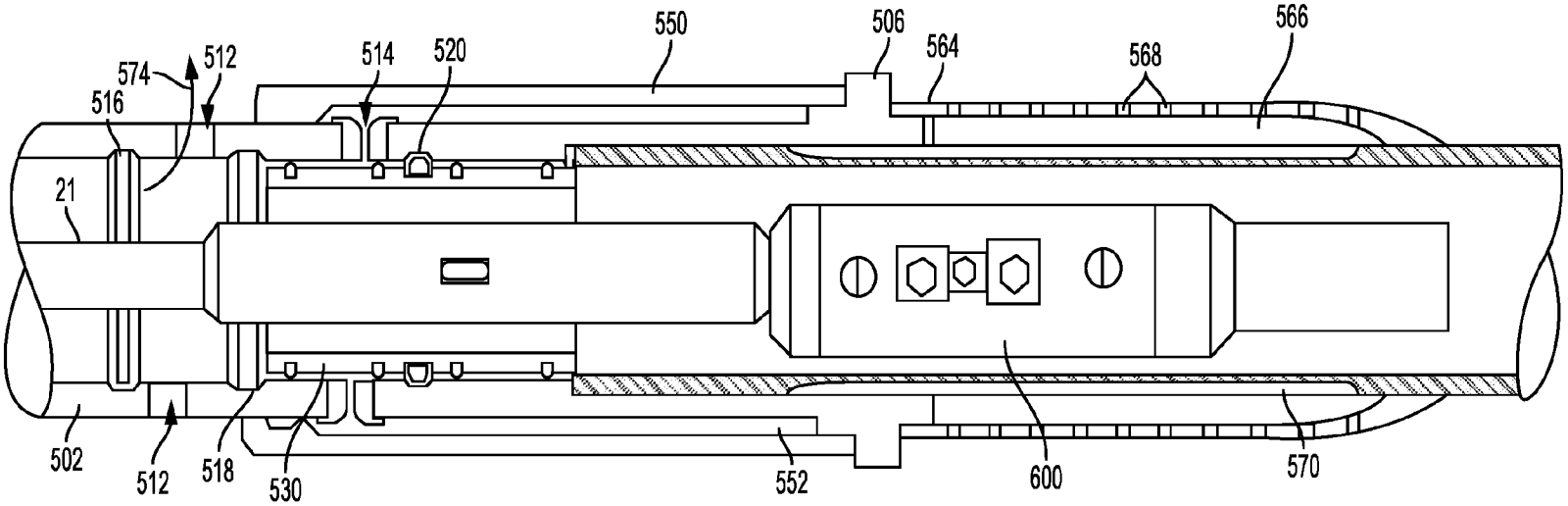
FIG. 20 is a cross sectional view of the control valve of FIG. 18 as taken along the line 19-19 with the sleeve in a second position and having a shifting tool located therein.
Figure 21:
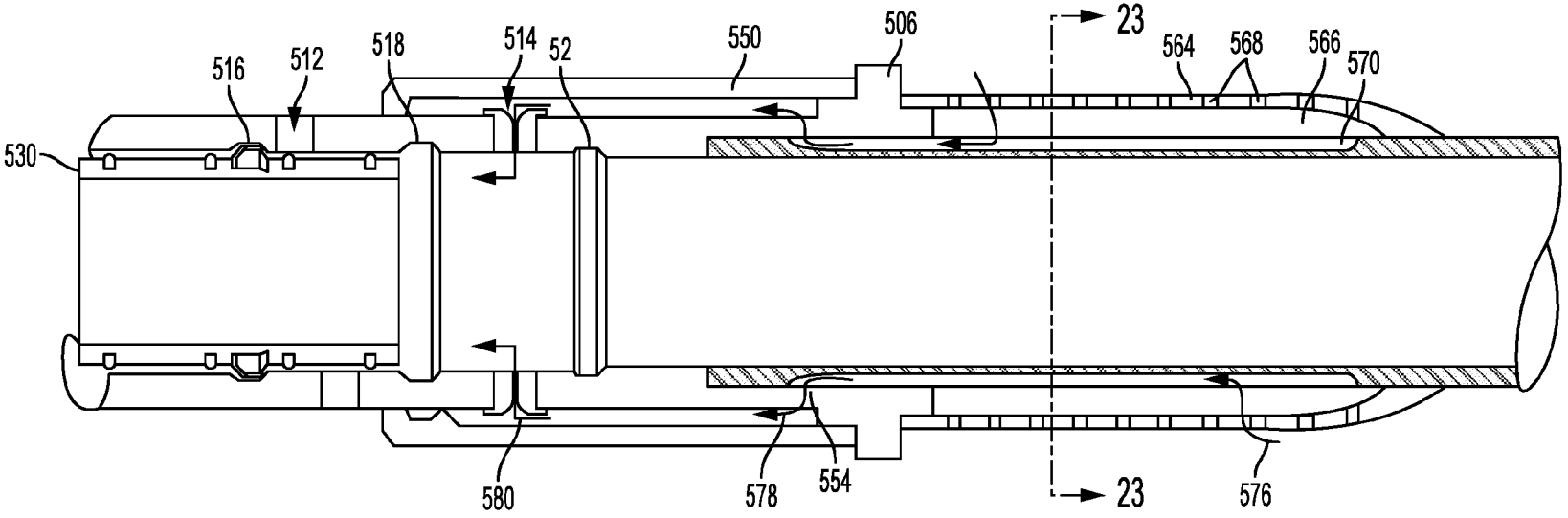
FIG. 21 is a cross sectional view of the control valve of FIG. 18 as taken along the line 19-19 with the sleeve in a third position.

The second set of ports 514 may be formed by an insert 540 located within bores 542 through the wall of the valve body. The inserts 540 may have throttling bores 544 therethrough selected to maintain a desired pressure across the second set of ports 514. The valve body 500 may include an outer sleeve 550 extending therearound so as to enclose the second set of ports 514 to the second end 506 of the valve body 500 and form an annular cavity 552 therebetween. As illustrated in FIGS. 19 through 21, the second end 506 of the valve body 500 includes a plurality of transfer bores 554 therethrough between the outer and inner surfaces of the valve body 500.

Figure 23:
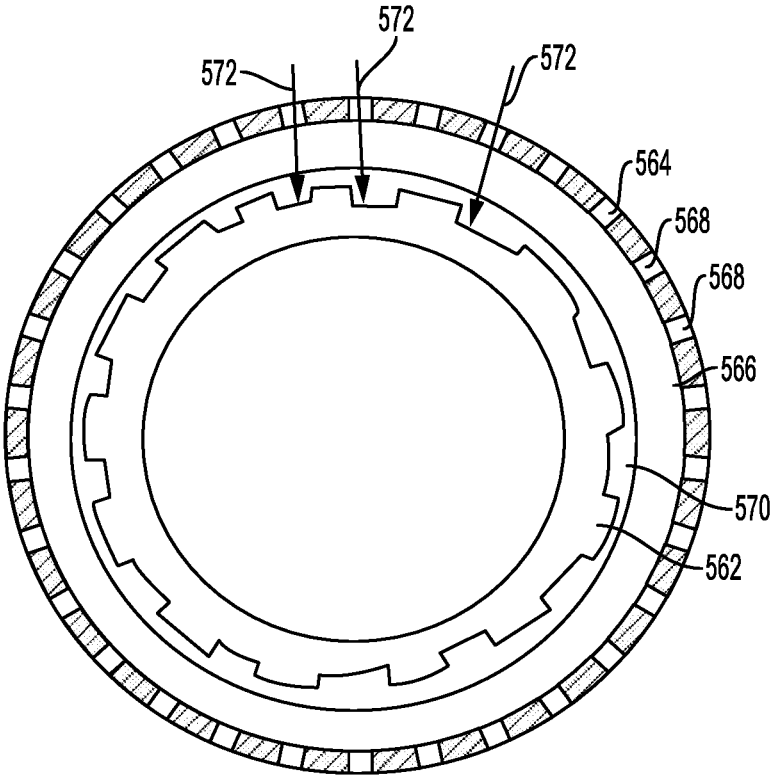
FIG. 23 is a cross sectional view of the filter section of the control valve of FIG. 21 as taken along the line 23-23.

As illustrated in FIGS. 19 through 21, the valve body may further include a filter section 560 secured to the second end 504 of the valve body 500. The filter section 560 is formed by an inner tubular body 562 secured to the inner surface of the valve body 500 closer towards the first end 504 from the transfer bores 554. The filter section further includes an outer tubular screen 564 extending from the second end 506 of the valve body 500 with a filter media 566 therebetween. The filter media may be of any suitable filter type, such as, by way of non-limiting example, a slotted pipe, perforated pipe, wire wrapped sleeve, pre-packed screens, MeshRite™ or FracRite™. The outer tubular screen 564 may be perforated or include a plurality of bores 568 therethrough. As illustrated in FIG. 23, the inner tubular body 562 may include a plurality of longitudinal slots 570 on the outer surface thereof extending to the transfer bores 554. In operation, fracking fluids or hydrocarbons are permitted to flow through the bores 568 and the filter media 566 so as to filter, screen or otherwise remove particles while permitting the fluid to be collected within the slots 570 and thereafter directed to the second set of ports 514 through the transfer bores 554 and annular cavity 552.

As illustrated in FIG. 19, the valve body 500 includes a longitudinally moveable sleeve 530 which may be positioned so as to block the flow of fluids though the first and second sets of ports 512 and 514. The sleeve 530 includes a radially expandable ring 532 therearound. An interior surface 515 of the valve body includes first, second and third annular grooves 516, 518 and 520, each sized to receive the ring 532 therein. The locations of the first, second and third annular grooves 516, 518 and 520 correspond to locations at which sleeve may be positioned to either block one or both of the first or second sets of ports. Optionally, the valve body 500 may include only one set of ports 512 wherein the sleeve 530 may be slidable moved between first and second positions to block and unblock the ports 512.

Figure 22:
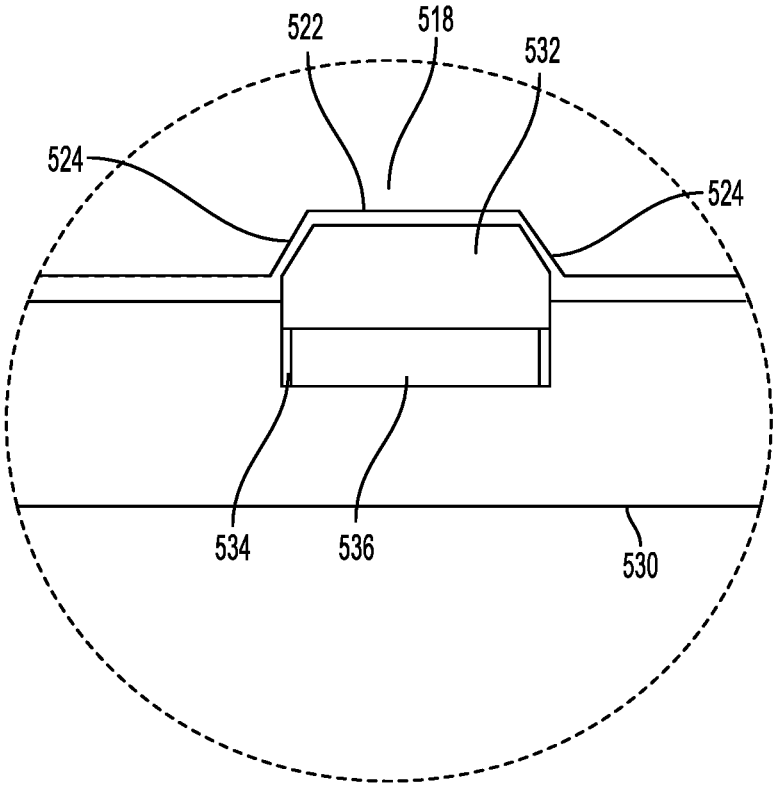
FIG. 22 is a detailed cross-sectional view of the ring and annular grove of the control valve of FIG. 19.

With reference to FIG. 22, the sleeve 530 includes an annular groove 534 therein sized to receive the ring 532. A radially biasing spring 536 is located below the ring 532 within the groove 534 so as to bias the ring in a radially outward direction. Examples of such springs may be a wave spring manufactured by Smalley Steel Ring Company. The annular grooves 516, 518 and 520 may be formed with a substantially flat bottom portion surface 522 with angularly oriented walls 524 to either side thereof. The ring 532 may be formed with so as to substantially conform to the shape of the annular grooves. It will be appreciated that during movement from one position to another, the angularly oriented walls 524 bear against the ring 532 so as radially compress the ring inwards when a sufficient longitudinal force is applied to the tools string. The strength of the spring 536 may be selected to provide a force sufficient to prevent unwanted movement of the sleeve out of the groove in which it is located. Such displacing force may be selected to be between 500 and 15,000 pounds-force. It will also be appreciated that when such a sufficient force has been applied to dislodge the sleeve from an annular groove, the resulting rapid movement of the shifting tool and sleeve will cause a pressure surge in any fluids located within the well. Such a pressure surge may be detected and measured by conventional means to indicate to an operator that the sleeve has been dislodged from the groove.

As illustrated in FIG. 19, the sleeve 530 may be located such that the ring 532 is located within the second annular groove 518. In such a position, both of the first and second sets of ports 512 and 514 will be closed and no fluids are permitted to flow into or out of the valve. In such a position, the zone corresponding to this valve will be closed. As illustrated in FIG. 20, the sleeve 530 may be located such that the ring 532 is located within the third annular groove 520. In such a position, the first set of ports 521 will be open and the second set of ports 514 will be closed. Such a position may be useful for fracking the zone corresponding to such a valve wherein the fracking fluid is permitted to flow through the first set of ports 512 in a direction generally indicated at 574. As illustrated in FIG. 21, the sleeve 530 may be positioned such that the ring 532 is located within the first annular groove 516 such that the first set of ports 512 is blocked while the second set of ports 514 is uncovered. In such a position, fluids are permitted to flow through the screen 564 and filter media 566 into the slots 570 in a direction generally indicated at 576. Thereafter the filtered fluid is collected through the transfer ports 554 in a direction generally indicated at 578 and through the second set of ports 514 in a direction generally indicated at 580. Such a configuration may be useful for collection of fracking fluids or during production of that zone.

Figure 24:
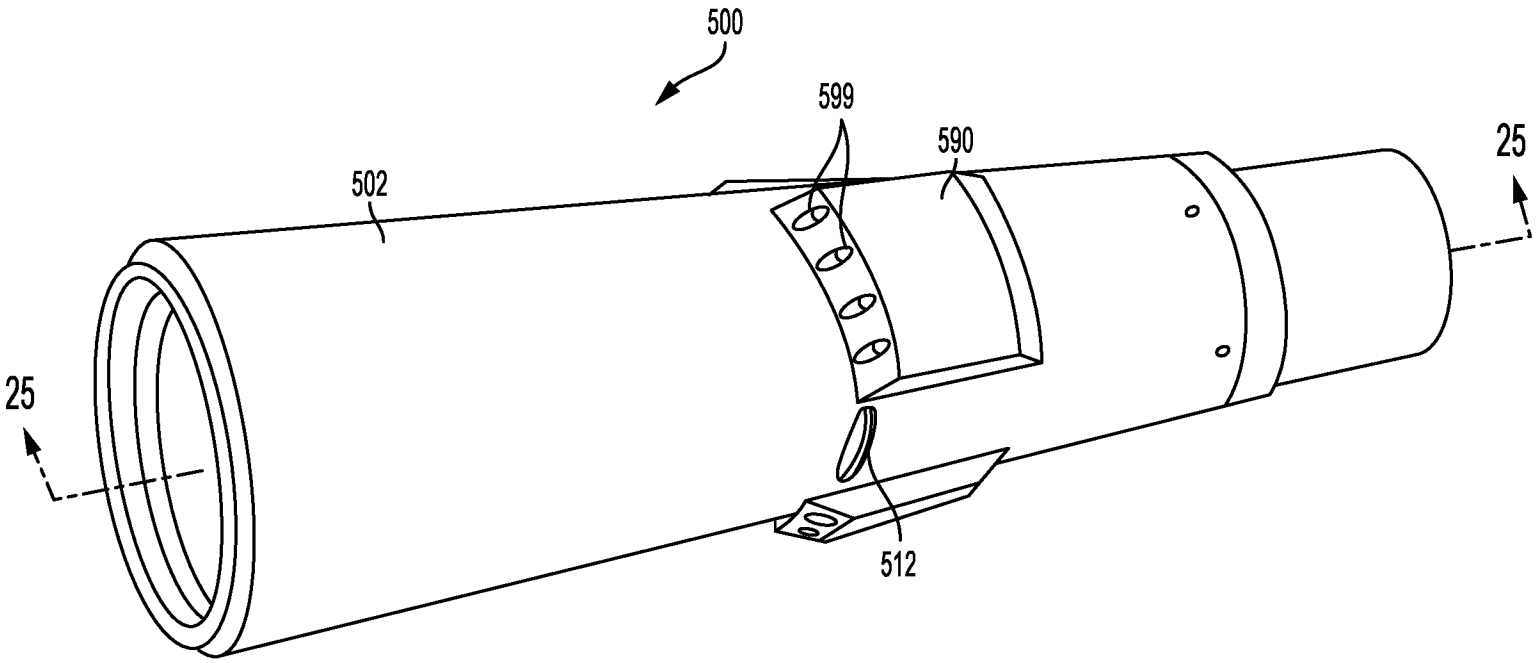
FIG. 24 is a perspective view of a control valve according to a further embodiment of the present invention.
Figure 25:
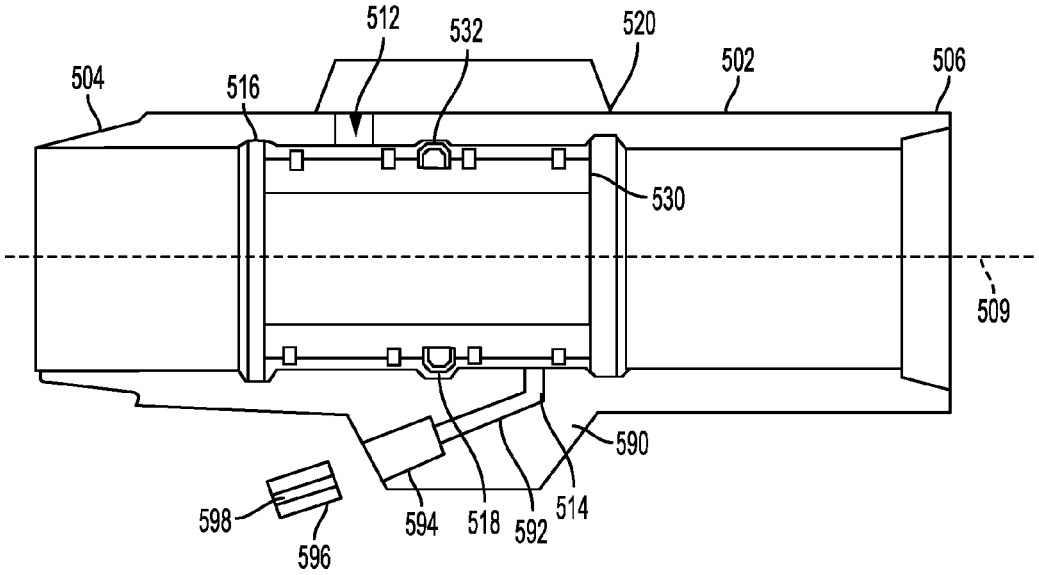
FIG. 25 is a cross sectional view of the control valve of FIG. 24 as taken along the line 25-25.

Turning now to FIGS. 24 and 25, an optional embodiment of the present invention is illustrated having fluid injection jet ports. The valve body 500 may include a plurality of protrusion bodies 590 extending therefrom having the first set of ports 512 located therebetween. As illustrated in FIG. 25, the protrusion bodies 590 have the second set of ports 514 therein which have an angular tube extending therefrom to an enlarged portion 594. The enlarged portion 594 may house a nozzle body 596, plug or other body therein. The nozzle body 596 may include a nozzle 598 therethrough for directing pressurized fluid into the well.

As set out above, the sleeve 530 may be located such that the ring 532 is located within the second annular groove 518 as illustrated in FIG. 25 so as to close both the first and second sets of ports 512 and 514 whereby no fluids are permitted to flow into or out of the valve. In such a position, the zone corresponding to this valve will be closed. The sleeve 530 may also be positioned such that the ring 532 is located within the first annular groove 516 such that the first set of ports 512 is blocked while the second set of ports 514 is uncovered. In such a position, fluids are permitted to flow through the screen second set of ports and thereby be ejected by the nozzles 596 so as to provide a stimulation or cleaning fluid to the well. The sleeve 530 may also be located such that the ring 532 is located within the third annular groove 520 so as to open the first set of ports 512 and thereby relieve or collect fluids from the well bore.

Figure 26:
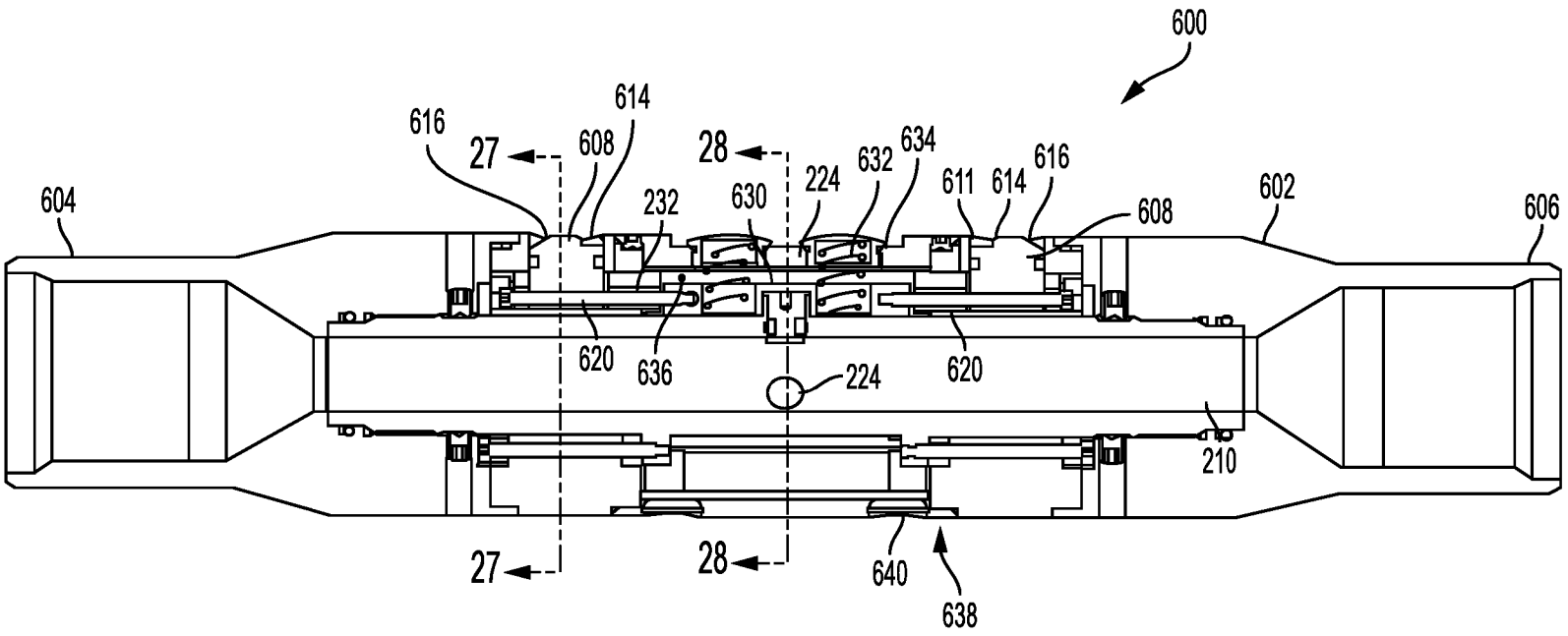
FIG. 26 is a cross sectional view of the shifting tool illustrated in FIG. 20 as taken along the longitudinal axis of the valve body and shifting tool.
Figure 27:
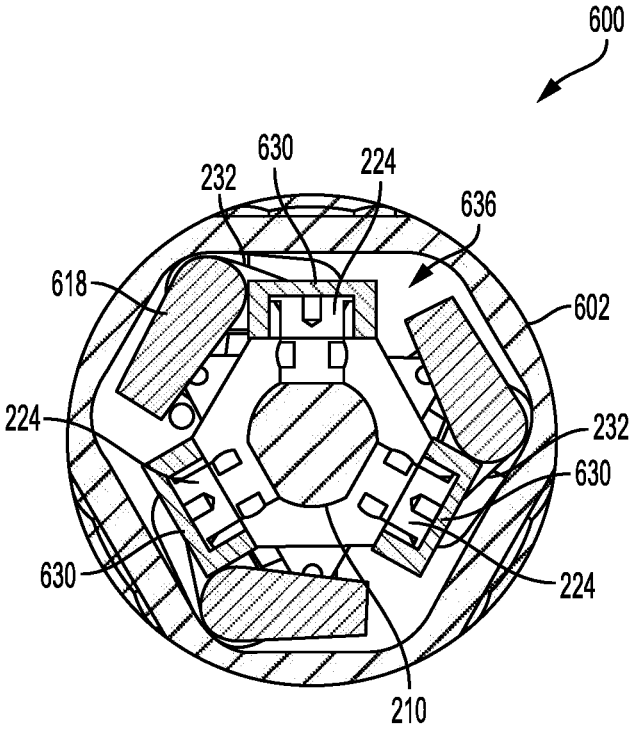
FIG. 27 is a cross sectional view of the shifting tool of FIG. 26 as taken along the line 27-27.
Figure 28:
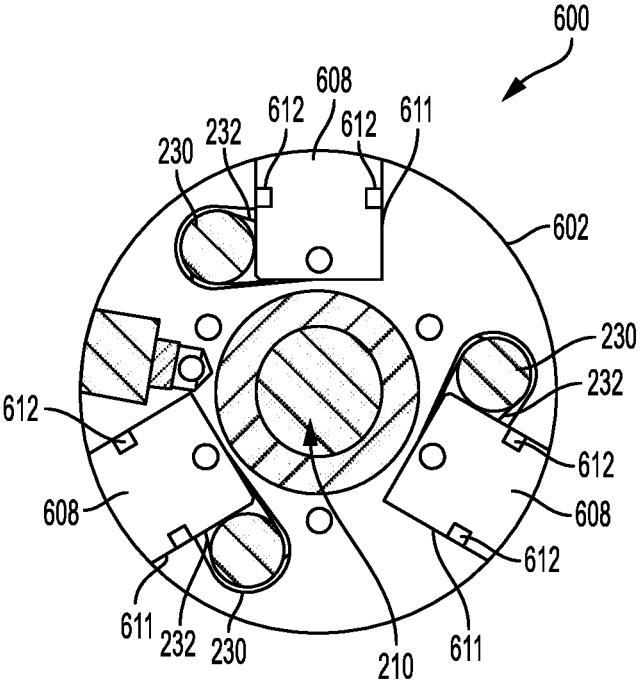
FIG. 28 is a cross sectional view of the shifting tool of FIG. 26 as taken along the line 28-28.

Turning now to FIGS. 26 through 28, an sealed shifting tool 600 is illustrated. As illustrated in FIGS. 26 and 27, the sealed shifting tool 600 comprises a tubular body 602 having no openings therethrough which are not sealed as will be more fully described below to prevent any entrapment of fluids or particulates therein. Similar to the shifting tool 200 described above, the sealed shifting tool tubular body 602 extending between first and second ends 604 and 606, respectively. The shifting tool 600 includes a central bore 210 therethrough to receive an actuator or to permit the passage of fluids and other tools therethrough.

The sealed shifting tool 600 includes at least one pair of sleeve engaging key pistons 608 located within radial key bores 611. Each pair of key pistons 208 are aligned along a longitudinal direction of the sealed shifting key and each include a lip 614 oriented towards each other for catching on a sleeve valve 44 and an inclined surface 616 oriented away from each other for surrounding the sliding sleeve and engaging a corresponding first or second end 43 or 45, respectively of the sliding sleeve 44 depending upon which direction the shifting tool 600 is displaced within the valve body 24 as set out above. The inclined surfaces 616 are adapted to engage upon either a shoulder 46 or 48 of the valve body as the shifting tool 600 is pulled or pushed there into so as to press the inclined surface 616 radially inwardly so as to press the sleeve engaging members 608 inwardly and thereby to disengage the sleeve engaging members 608 from the sliding sleeve 44 when the sliding sleeve 44 has been shifted to a desired position proximate to one of the annular shoulders. As illustrated, each key piston 608 and its corresponding key bore 611 may be have a circular cross section, although it will be appreciated that other shapes may be useful as well, such as, by way of non-limiting example, oval, square, rectagonal, triangular or irregular. As illustrated in FIG. 28, each key piston 608 is slidably sealed within its key bore 611 by a slidable seal 612 as are known.

Similar to the shifting tool 200 above, each pair of key pistons 608 are maintained parallel to the tubular body 602 of the shifting tool 600 by a parallel shaft 230. Each parallel shaft 230 is linked to a sleeve engaging member 208 by a pair of spaced apart linking arms 232. The parallel shaft 230 is rotatably supported within the shifting tool tubular body 602 by a linkage 618, bearings or the like. The linking arms 232 are fixedly attached to the parallel shaft 230 at a proximate end and to a piston pins 620 at distal ends thereof. The piston pins 620 extend through the distal ends of the linking arms 232 as well as the key pistons 608 so as to fix the motion of each key piston 608 to each other. It will be appreciated that maintaining the key pistons 608 parallel to each other to not catch on any other obstructions that could be in the well Similar to the shifting tool 200 above, the sealed shifting tool 600 includes a shifting bore 226 therein at a location corresponding to each pair of piston keys 608 which includes a piston 224 extending radially therefrom which is received within the shifting bore 226. Each piston 224 includes a piston cap 630 thereover which extends longitudinally to each side of the piston 224.

The piston pins 620 extend into and are engaged within the piston cap 630 so as to translate the movements of the piston 224 to each key piston 608. As illustrated in FIG. 26, the sealed shifting tool 600 also includes balancing springs 632 located between the piston cap 630 and adjusting caps 634. The adjusting caps 634 may be threadably moved radially inwards or outwards to adjust the biasing force on the piston cap 630. As set out above, the balancing springs 632 bias the piston cap and thereby the piston 224 and piston keys 608 to the retraced position.

As illustrated in FIG. 26, each of the piston cap, parallel shaft, linking arms 232, piston pins 620 and springs 632 are isolated sealed from the central bore 210 within a chamber 636. The chamber 636 is also sealed against the entrance of any particles to prevent fouling of the components located therein. The chamber 636 may include one or more balancing bores 638 extending between the chamber 636 and the exterior of the shifting tool to permit fluids to pass between the chamber 636 and the tool exterior so as to fluidically balance the chamber and the tool exterior. In such embodiments, the balancing bore 638 will include a filter 640 to prevent the entrance of any particles as are commonly known.

While specific embodiments of the invention have been described and illustrated, such embodiments should be considered illustrative of the invention only and not as limiting the invention as construed in accordance with the accompanying claims.

What is claimed is:

1. An apparatus for selectably permitting fluidic communication between an interior and an exterior of a well assembly comprising:

a tubular body extending between first and second ends and having a central passage extending therebetween, said first and second ends being connectable to said well assembly such that said central passage is in fluidic communication with an interior of said well assembly;

at least one set of passages extending through said tubular body between said central passage and an exterior of said tubular body;

a sleeve slidably located within said central passage of said tubular body adapted to selectably sealably cover or uncover said at least one sets of passages;

a shifting tool slidably locatable within said sleeve at an end of a tool strong said shifting tool being engagable upon said sleeve so as to permit said shifting tool to move said sleeve longitudinally within said tubular body; and first and second sets of passages extending through said tubular body, wherein said second set of passages includes flow channels extending along said tubular body and having a filter located therearound.

2. The apparatus of claim 1 wherein said sleeve is locatable at a first position covering both of said first and second sets of passages, a second sets of passages, a second position covering said first set of passages and uncovering said second set of passages and a third position uncovering said first set of passages and covering said second set of passages.

3. The apparatus of claim 1 wherein said second set of passages include a plurality of outlet nozzles positioned to direct a flow of fluid to said exterior of said well assembly.

4. The apparatus of claim 3 wherein said nozzles are oriented substantially parallel to a central axis of said tubular member.

5. The apparatus of claim 1 wherein said central passage include at least one annular groove therein corresponding to a desired position of said sleeve wherein said sleeve includes a retaining ring disposed there around receivable within said at least one annular groove.

6. The apparatus of claim 5 wherein said retaining ring comprises a split ring surrounding said sleeve having a radially biasing spring between said split ring and said sleeve.

7. The apparatus of claim 6 wherein said split ring and said radially biasing spring are located within an annular groove around said sleeve.

8. The apparatus of claim 6 wherein said annular groove includes sloped sidewalls and wherein said radially biasing spring has a biasing force selected to be retained within said annular groove once a predetermined displacing force has been applied to said tool string.

9. An apparatus for selectably permitting fluidic communication between an interior and an exterior of a well assembly comprising:

a tubular body extending between first and second ends and having a central passage extending therebetween, said first and second ends being connectable to said well assembly such that said central passage is in fluidic communication with an interior of said well assembly;

at least one set of passages extending through said tubular body between said central passage and an exterior of said tubular body;

a sleeve slidably located within said central passage of said tubular body adapted to selectably sealably cover or uncover said at least one sets of passages; and a shifting tool slidably locatable within said sleeve at an end of a tool strong said shifting tool being engagable upon said sleeve so as to permit said shifting tool to move said sleeve longitudinally within said tubular body, wherein said shifting tool comprises:

a body having a central bore extending therethrough and an outer surface;

at least one shifting bore extending from said central bore wherein each shifting bore include a actuating piston located therein;

first and second key bores extending radially inwards from said outer surface; and first and second piston keys located within said first and second key bores, each of said first and second piston keys having sleeve engaging surface thereon spaced apart by a distance selected to retain said sleeve therebetween, wherein each of said first and second piston keys are operably connected to said actuating piston so as to be extended from said outer surface when said central bore is supplied with a pressurized fluid.

10. The apparatus of claim 9 wherein said first and second piston keys and said actuating piston are each operably connected to a common shaft with arms extending from said shaft.

11. The apparatus of claim 10 wherein said shaft and said arms are contained within a chamber in said body.

12. The apparatus of claim 10 wherein said chamber is in fluidic communication with said outer surface of said body through a balancing bore.

13. The apparatus of claim 12 wherein said balancing bore include a filter therein.

14. The apparatus of claim 11 wherein said shaft is biased to urge said first and second piston keys to a retracted position.

15. The apparatus of claim 14 wherein said shaft is biases by at least one spring biasing a spring arm extending from said shaft.

16. The apparatus of claim 15 wherein said spring located within a spring bore extending from said outer surface of said body is compressed between said spring arm and an adjusting cap located within said spring bore.

17. The apparatus of claim 16 wherein said adjusting cap is threadably located within said spring bore.

* * * * *